US007837862B2

(12) United States Patent
Poshusta et al.

(10) Patent No.: US 7,837,862 B2
(45) Date of Patent: Nov. 23, 2010

(54) METHOD FOR REMOVING SULFUR OR OTHER CONTAMINANT SPECIES FROM HYDROCARBON FUELS OR OTHER FUELS

(75) Inventors: Joseph C. Poshusta, Broomfield, CO (US); Jerry L. Martin, Superior, CO (US)

(73) Assignee: Protonex Technology, LLC, Broomfield, CO (US)

( * ) Notice: Subject to any disclaimer, the term of this patent is extended or adjusted under 35 U.S.C. 154(b) by 428 days.

(21) Appl. No.: 12/042,187

(22) Filed: Mar. 4, 2008

(65) Prior Publication Data

US 2008/0289496 A1 Nov. 27, 2008

Related U.S. Application Data

(62) Division of application No. 10/961,480, filed on Oct. 7, 2004, now Pat. No. 7,344,686.

(51) Int. Cl.
*C10G 17/00* (2006.01)
*C10G 25/00* (2006.01)

(52) U.S. Cl. ..... 208/208 R; 208/210; 208/213; 585/822; 423/230

(58) Field of Classification Search ..... 208/208 R, 208/210, 213; 585/822; 423/230
See application file for complete search history.

(56) References Cited

U.S. PATENT DOCUMENTS 2,985,589 A * 5/1961 Broughton et al. ..... 210/676
3,040,777 A * 6/1962 Carson et al. ..... 137/625.15
3,192,954 A * 7/1965 Gerhold et al. ..... 137/625.11
4,629,664 A * 12/1986 Tsukui et al. ..... 429/449
4,865,826 A * 9/1989 Carnell et al. ..... 423/230
4,923,616 A * 5/1990 Hirata et al. ..... 210/676
4,994,257 A * 2/1991 Suehiro et al. ..... 423/577
5,026,528 A * 6/1991 Gal ..... 422/111
5,497,753 A * 3/1996 Kopera ..... 123/494
5,578,093 A * 11/1996 Campbell et al. ..... 48/128
5,593,478 A * 1/1997 Hill et al. ..... 96/111
6,306,285 B1 * 10/2001 Narayanan et al. ..... 205/787
6,311,719 B1 * 11/2001 Hill et al. ..... 137/312
6,406,523 B1 * 6/2002 Connor et al. ..... 96/125
6,451,095 B1 * 9/2002 Keefer et al. ..... 96/125
6,488,837 B1 * 12/2002 Ren et al. ..... 205/787
6,514,318 B2 * 2/2003 Keefer ..... 95/96
6,531,052 B1 * 3/2003 Frye et al. ..... 208/189
6,533,846 B1 * 3/2003 Keefer et al. ..... 96/125
6,565,635 B2 * 5/2003 Keefer et al. ..... 96/125
6,635,795 B2 * 10/2003 Gislason et al. ..... 585/820
6,736,961 B2 * 5/2004 Plummer et al. ..... 208/208 R
6,869,522 B2 * 3/2005 Khare et al. ..... 208/299
6,904,936 B2 * 6/2005 Ma ..... 137/625.47
7,141,172 B2 * 11/2006 Wang et al. ..... 210/659
7,744,824 B2 * 6/2010 Vanderspurt et al. ..... 422/178
2003/0226786 A1 * 12/2003 Feimer et al. ..... 208/299
2004/0007506 A1 * 1/2004 Song et al. ..... 208/244

* cited by examiner

*Primary Examiner*—N. Bhat
(74) *Attorney, Agent, or Firm*—James R. Young; Cochran Freund & Young LLC

(57) ABSTRACT

Fuel is desulfurized with a rapid cycle desulfurization-regeneration method and apparatus. Regeneratable mass separating agents, including metals supported on high surface area materials, are used in a plurality of beds that are rotated into, through, and out of a desulfurization series and a regeneration series by valves and plumbing, which can include a rotary valve apparatus.

80 Claims, 14 Drawing Sheets

Comparison of selected sorbents for the desulfurization of NATO F-76 with 10,000 ppm sulfur.

Six adsorption/regeneration cycles for AC/Cu/$H_2SiO_2$ sorbent.

The first 4 adsorption/regeneration cycles of the AC/Pd/SI1254 sorbent.

The 5th and 10th adsorption cycle compared to the 1st for the AC/Pd/SI1254 sorbent.

METHOD FOR REMOVING SULFUR OR OTHER CONTAMINANT SPECIES FROM HYDROCARBON FUELS OR OTHER FUELS

This application is a divisional application of U.S. patent application Ser. No. 10/961,480, filed Oct. 7, 2004, now U.S. Pat. No. 7,344,686.

CONTRACTUAL ORIGIN OF THE INVENTION

This invention was made with Government support under N00014-03-C-0498 awarded by the U.S. Navy Office of Naval Research. The Government has certain rights in the invention.

BACKGROUND OF THE INVENTION

1. Field of the Invention

The present invention relates to desulfurization of fuels, and more specifically to optimized sorbent materials and processing for efficient desulfurization of high sulfur content fuels.

2. State of the Prior Art

Fuel cells powered by liquid hydrocarbon fuels promise to have very high power density and efficiency, which is of great interest in military and commercial markets. However, many conventional hydrocarbon fuels have high sulfur or sulfur compound contents usually in the form of organo-sulfur compounds, such as thiophenes and dibenzothiophenes, and such sulfur poisons the catalysts that are central to the conversion of fuel to electric energy in fuel cells. Therefore, for fuel cells to be usable with conventional fuels, the sulfur containing molecular species must be removed. This problem has been a detriment to development of fuel cell electric power generator systems, especially for small scale portable and mobile systems that would be used in circumstances that are not conducive to the use of large, fixed beds or other complex desulfurization systems, yet are likely to encounter fuels with too much sulfur for sustained fuel cell operation.

State of the art desulfurization systems utilize fixed beds of sorbent to selectively remove sulfur from fuels. When hydrocarbon fuels that contain sulfur compounds are flowed through the fixed beds of sorbent materials, the sulfur compounds are retained by the sorbent materials, while the hydrocarbon fuels exit substantially free of sulfur. When the sorbent materials become saturated with sulfur and other adsorbed materials and are no longer effective for further sulfur removal, the bed must be replaced. This state of the art has been inimical to the use of fuel cells to generate power from conventional fuels on portable platforms, such as automobiles, recreational vehicles, portable generators for industrial or military uses, or even ships. To be useful and practical, enough fuel must be desulfurized on the portable platform to accomplish the mission or to continue operating the fuel cell power generator until the next maintenance period. Therefore, to reduce the maintenance burden and still meet operational requirements, a large enough sorbent bed must be carried on the portable platform to treat enough fuel to keep the fuel cell operating for the duration of the maintenance interval. Of course, larger sorbent beds with more sorbent can desulfurize more fuel, but for most applications, the amounts of sorbent needed to provide enough desulfurized fuel for practical applications would be impractical to carry along on the portable platform. In addition, there would also be the need to have replacement sorbent available as well as the problem and expense of disposal of used sorbent.

Consequently, most of the research efforts to solve this problem have been directed toward finding or developing sorbent materials that are both selective, i.e., that minimize adsorption of non-sulfur species and have more available capacity for adsorption of sulfur species, and toward finding or developing sorbent materials that have more adsorption capacity, in general. The theory of that approach is that with more adsorption capacity and not wasting it on non-sulfur species, less sorbent would be needed to provide the fuel needs of any particular application. Such efforts to date have not been successful enough to make fuel cells practical for mobile power generation with conventional fuels, and there appears to be little likelihood of achieving such success in the near future.

SUMMARY OF THE INVENTION

An object of this invention, therefore, is to provide improved processes, apparatus, and materials for desulfurizing hydrocarbon fuels and combinations thereof for more efficient desulfurizing of hydrocarbon fuels.

Additional objects, advantages, and novel features of the invention are set forth in part in the description that follows and will become apparent to those skilled in the art upon examination and understanding of the following description and figures or may be learned by the practice of the invention. To achieve the foregoing and other objects and in accordance with the purposes of the present invention, it had to be conceived and recognized first that, if a mass separating agent capable of removing sulfur species from the fuel could be regenerated rapidly and repeatedly an indefinite number of times, a more efficient and productive fuel desulfurization process would be feasible, even if the mass separating agent does not have the best capacity. Once that conception and realization was made, it lead to the development of sorbents that have good capacity as well as excellent regeneration capabilities, rapid cycle desulfurization-regeneration apparatus and methods in which such sorbents can be used to produce a continuous flow of desulfurized fuel.

BRIEF DESCRIPTION OF THE DRAWINGS

The accompanying drawings, which are incorporated in and form a part of the specification, illustrate the preferred embodiments of the present invention, and together with the descriptions serve to explain the principles of the invention. In the drawings.

DETAILED DESCRIPTION OF THE PREFERRED EMBODIMENTS

Figure 1:
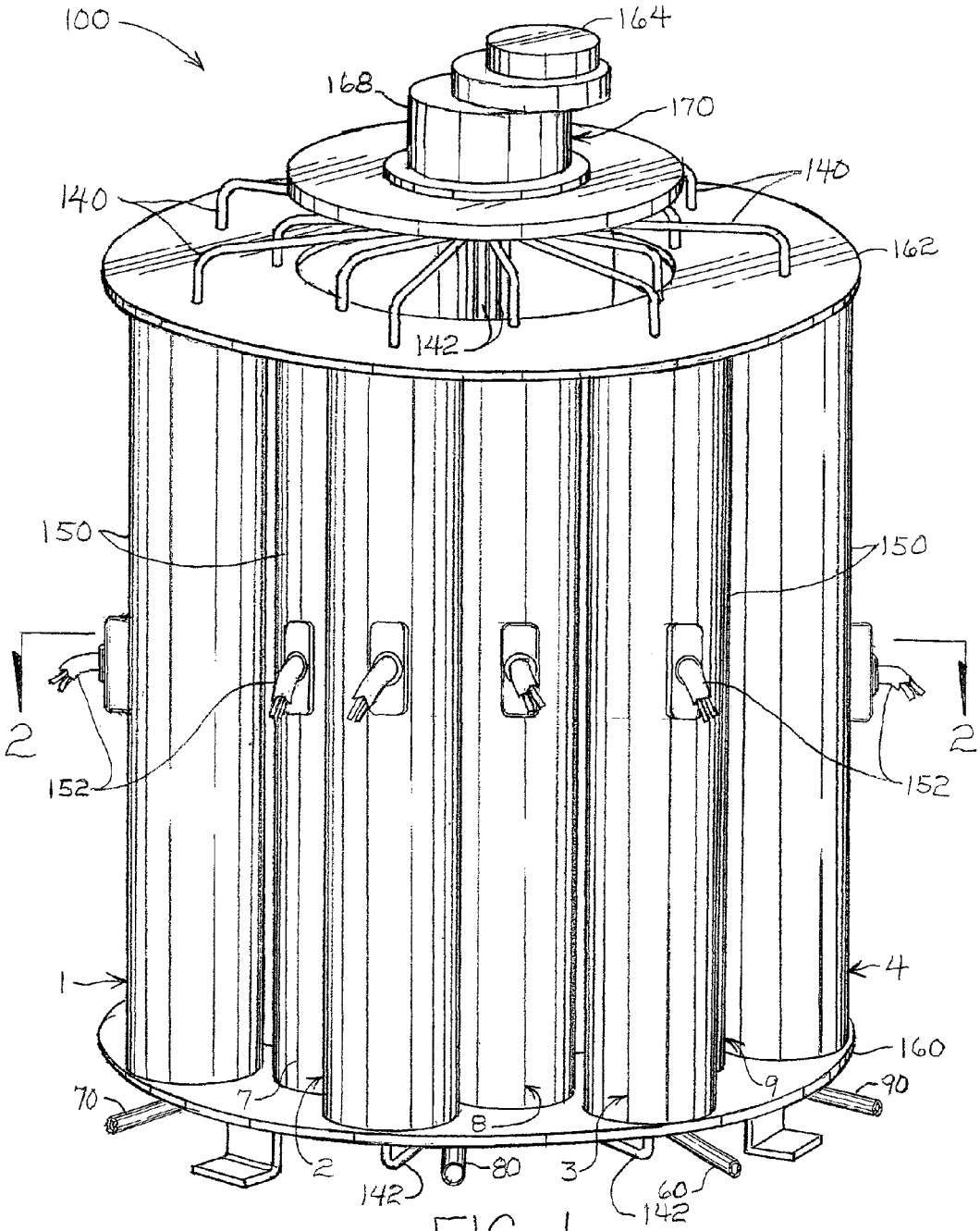
FIG. 1 is an isometric view of an example rapid cycle desulfurizer apparatus according to this invention.

The fuel desulfurizer system of this invention is based on a sulfur species selective sorption-regeneration cycle that operates continuously to produce an indefinite flow of desulfurized fuel. Some sorbent capacity is compromised in order to utilize sorbent materials that can be regenerated easily and rapidly through large numbers of cycles to produce a continuous flow of desulfurized fuel indefinitely. The preferred embodiment combines the features of: (i) Regenerable sulfur adsorbent material for liquid fuels; (ii) A highly optimized sorbent bed arrangement; and (iii) Simple and reliable mechanical apparatus for switching the beds among various stages of sorption and regeneration modes.

A preferred sulfur sorbent material is a high surface area silica or silica gel coated with palladium, which can be regenerated with hot air and/or hydrogen through an indefinite number of cycles without significant loss of capacity. Other suitable regenerable sorbent materials include silica or silica gel with or without a metal coating, but coatings with metals that are combustion catalysts are preferred. Examples of suitable combustion catalyst metals for use as sorbents in this invention include palladium, platinum, rhodium, and copper. Other high surface area materials, including alumina, activated carbon, zeolites, and other microporous and mesoporous materials with or without various metals also have acceptable selectivity, capacity, and regenerable characteristics that are very usable in this invention. A preferred regenerating agent is air (heated to the extent required to desorb and oxidize sulfur-containing molecular species), although other gas and liquid solvents are also feasible and can be used in the methods and apparatus and with the materials of this invention. The regeneration task is to release the sulfur species from the sorbent material. A preferred sorbent bed arrangement, an example of which is shown in the fuel desulfurizer apparatus 100 in FIGS. 1 and 2, includes a plurality of sorbent beds, such as beds 1-12 in FIGS. 1 and 2, which can be cycled through various stages of adsorption and regeneration, as will be explained in more detail below, to optimize use of the adsorbent material in the beds. The preferred switching apparatus includes a rotary valve 170, as will also be explained in more detail below, although other kinds of valve arrangements to implement the progressive simulated moving bed desulfurization regeneration cycling of this invention can also be used.

Instead of attempting to find or produce a sorbent material with the most sulfur adsorbing capacity to provide sufficient quantities of desulfurized hydrocarbon fuels for portable and other hydrocarbon fueled electric power generators and other uses in which carrying or disposing of spent sorbent is a problem, this invention includes a recognition that a combination of on-site regeneration of sorbent material along with on-site adsorption and removal of sulfur from the hydrocarbon fuels can provide a better solution, if it can be done in a more efficient, consistent, and sustainable manner over long periods of time. While the general concept of regenerating sulfur adsorbing material, i.e., getting the material to desorb the sulfur so that it can be used again, is not new with this invention, that concept alone has not been sufficient to overcome the obstacles to practical implementation of fuel desulfurization, especially for portable fuel cell power generation, but also for fuel cell power generation systems in general. Adsorbent materials of the best known sulfur adsorbing capacity are among the worst for regeneration.

An important feature of this invention, therefore, is to provide and utilize adsorbents that may not have the best adsorption capacity, but that, first and foremost, can be regenerated many times with practical and easily implemented regeneration techniques and still retain whatever capacity they have, and to provide simple and reliable mechanical systems for putting such adsorbent materials through innumerable fairly rapid cycles (e.g., one to six hours instead of days) to continuously produce a sustained flow of desulfurized fuel indefinitely or at least for a long time before requiring replacement. Consequently, the process of this invention allows a dramatic reduction in the amount of sorbent required to desulfurize a given quantity of fuel as compared to higher capacity sorbents used in traditional fixed bed or non-regenerating desulfurization processes by making more efficient use of the available lower capacity, but regenerable, sorbent through continuous adsorption-regeneration recycling at optimal rates. This reduction in sorbent mass has several key advantages, especially for mobile fuel cell power generators, but which will also be beneficial in stationary fuel cell generation systems as well.

For example, on-board desulfurization of fuels, including heavily contaminated military fuels, is feasible in smaller packages than fixed bed or non-regenerating systems, and the burdens and expense of disposal of toxic sulfided sorbents and reloading beds with new sorbent are reduced or eliminated. Further, the continuous adsorption-regeneration cycling process of this invention makes it feasible and practical to use more expensive sorbents with excellent sulfur selectivity, albeit lower adsorption capacity, as long as they can be regenerated. Of course, an adsorbent material that meets the criteria of regenerability without significant loss of capacity, but which also has very good, if not the best, sulfur adsorbent capacity, is also a desirable and beneficial feature of this invention when implemented in the continuous adsorption-regeneration recycling process of this invention.

To avoid confusion, it is helpful to define the term sorbent. Both adsorbents and absorbents are called sorbents. Adsorbent is a solid material on the surface of which liquid or gaseous species can form physical bonds by Van der Waals or electrostatic attraction or by complexation mechanics. Absorbent is a solid liquid or solution that can take up molecules from another phase (usually a gas phase) by dissolution or by chemical reaction. For example, zinc oxide is a common reactive desulfurization material that absorbs sulfur from hydrogen sulfide to form zinc sulfide.

Figure 2:
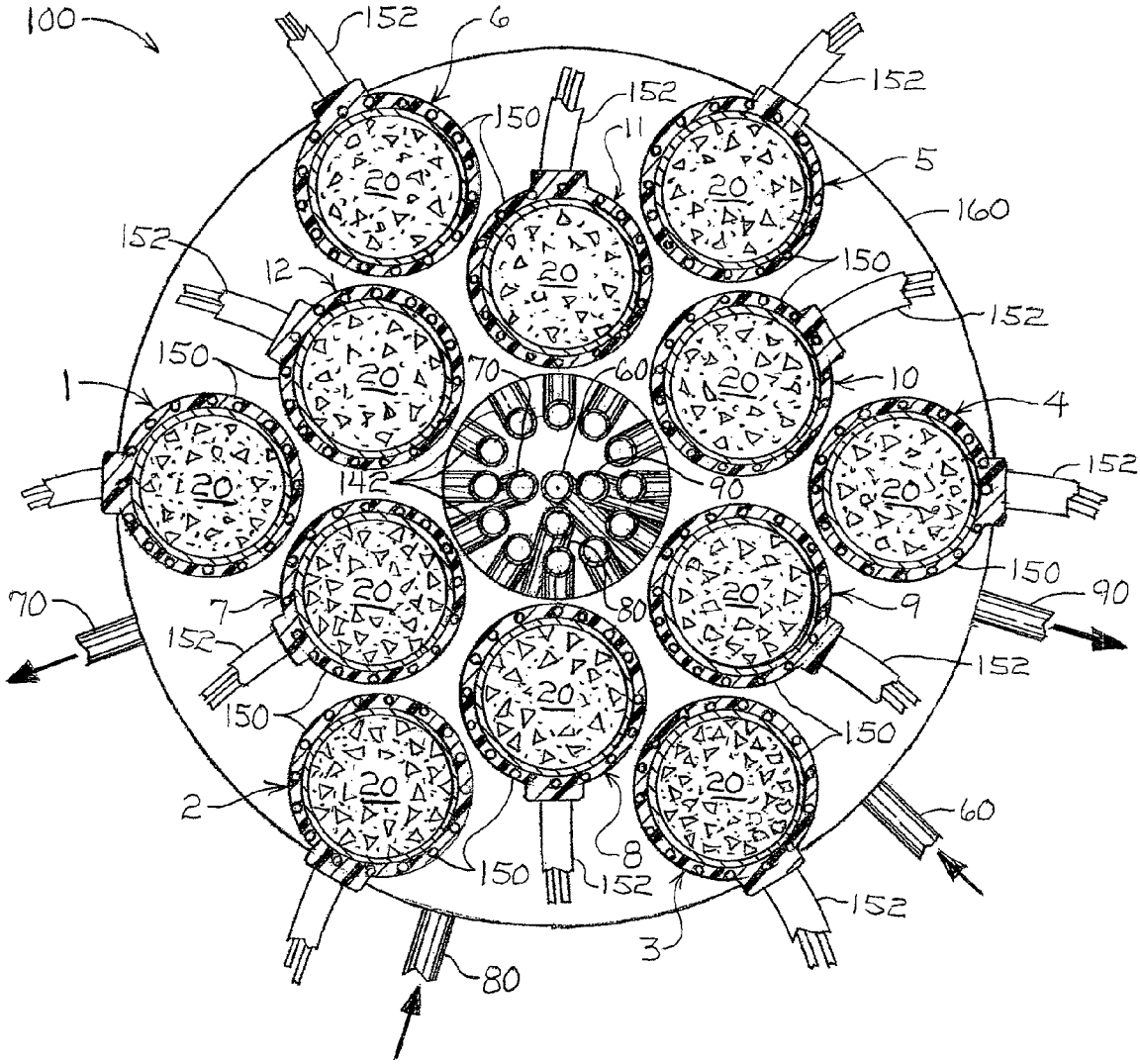
FIG. 2 is a cross-sectional view illustrating the principles of the desulfurizer apparatus taken along section line 2-2 in FIG. 1.
Figure 3:
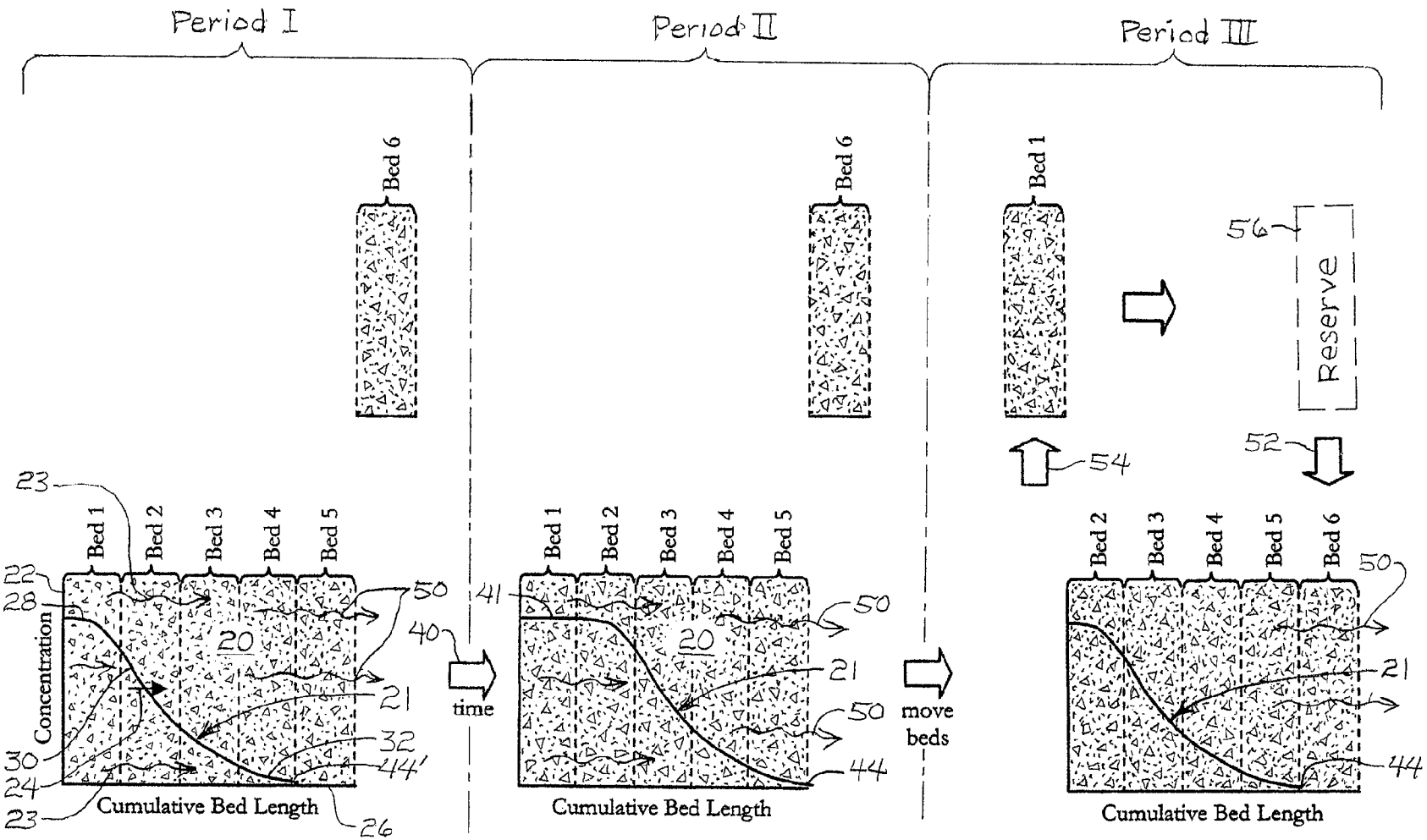
FIG. 3 is a diagrammatic view of the desulfurization process of this invention.

To illustrate the adsorption-regeneration cycle process utilized to implement this invention and to explain the emphasis on the requirements of a regenerable adsorbent material for this invention, reference is made now to FIG. 3. In this graphical representation, this principle of the invention is illustrated with an example of six adsorbent beds instead of the twelve beds 1-12 in the example desulfurizer apparatus of FIGS. 1 and 2.

Curve 21 in FIG. 3 is a graphical representation of sulfur concentration on a scale 22 in a fuel flowing as indicated by arrows 23 through an arbitrary length 26 of a sorbent 20, preferably comprising an adsorbent material, through three time periods or stages I, II, and III of a desulfurization cycle. The concentration and length units are arbitrary, because it is the relationship between them, not specific numbers, that is important. The quantity of the sorbent 20 and its sorbent capacity are also arbitrary, again because it is the relationship shown in the graph, not absolute quantities, that illustrate the principle of this invention. As indicated by the upper portion 28 of the curve 21 in phase I, the sulfur concentration in the fuel is high, e.g., equal to the natural sulfur concentration in the fuel, when the fuel first encounters the mass of sorbent material 20, and, as shown by the mid-portion 30 of the curve 21, the sulfur concentration of the fuel decreases fairly rapidly as it flows from front to back through the sorbent 20, because the sulfur-containing molecular species are adsorbed or absorbed by the sorbent 20 and effectively removed from the fuel flow 23. Then, as the fuel flow 23 continues through the mass of sorbent 20, the tail portion 32 of the curve flattens as most of the sulfur by then has been adsorbed and removed from the fuel, and the concentration approaches zero well before the fuel flow 23 reaches the end of the length 26 of sorbent 20. Ideally, the sulfur concentration reaches zero before the fuel flow 50 exits the back of the sorbent 20. In reality, some residual amount of sulfur may remain in the fuel, which is not significant for purposes of this invention. In this example, as well as other examples in the description below, "front" refers to sorbent and/or bed at the beginning of the fuel flow, and "back" or "end" refers to the sorbent and/or bed at the end of the fuel flow, i.e., where the fuel exits the last portion of the sorbent or the last bed in a series through which the fuel flows before exiting.

After the passage of some amount of time, the portion of the sorbent 20 near the beginning or front of the flow will become saturated or "full" of sulfur, i.e., will have reached an equilibrium where it desorbs as much sulfur to the fuel flow as it sorbs from the fuel flow. The area below the curve 21 is indicative of the proportion of sorbent 20 that contains sulfur as compared to the area above the curve 21, which is indicative of the proportion of sorbent 20 that still has remaining, unused adsorbent capacity. The time required for such sorbent to reach equilibrium, where it has no more additional capacity to remove sulfur from the fuel entering the bed, will depend on the sorption equilibrium characteristics of the sorbent, the dimensions of the sorbent bed, the concentration of sulfur in the fuel, the flow rate of the fuel, concentration of other species in the fuel that are also sorbed by the sorbent 20, temperature, and other factors. As the portion of the sorbent 20 near the front of the cumulative bed length becomes saturated, the curve 21 shifts to the right in the graph, i.e., toward the back of the sorbent 20, as illustrated by the arrow 24. Eventually, after a period of time 40, the curve 21 will have moved to the right, i.e., toward the back, enough to reach the position for curve 21 shown in period II of FIG. 3. As can be seen from the elongated flat portion 41 of the curve 21 in the graph for period II, the sulfur concentration in the fuel near the beginning of cumulative bed length, i.e., where the fuel flows into the sorbent material 20, remains constant, because the sorbent material near the front is in equilibrium with the sulfur concentration in the untreated fuel. At the same time, as illustrated in period II, the portions of the sorbent 20 in the middle and end portions does still have additional adsorption capacity and does continue to adsorb sulfur so that the concentration of sulfur in the fuel represented by the curve 21 continues to decrease.

However, as more of the sorbent 20 reaches equilibrium with the untreated fuel sulfur concentration and the concentration curve 21 continues to shift to the right, there will come a point in time when fuel flowing out of the back or end of the sorbent material 20, as indicated by arrow 50, does not have all of the sulfur removed, as indicated by the point 44 on curve 21 in period II. That point is sometimes referred to as the "breakthrough" point, where sulfur in the fuel flow 50 breaks through the bed 20. At that point, unless the sorbent 20 is changed or something is done to add more capacity to the sorbent 20, the concentration of sulfur in the out-flowing fuel 50 will continue to rise as the sorbent bed becomes less and less effective at removing sulfur. Again, as mentioned above, it may not be possible to actually reduce the sulfur concentration to zero, so, in a practical sense, the breakthrough point may be considered the point at which the available sorbent capacity can no longer keep the sulfur concentration at a minimum or below some desired maximum sulfur concentration threshold.

In conventional practice, when breakthrough occurs, fuel flow 23 is stopped to prevent sulfur from reaching downstream processes. Once stopped, the sorbent 20 is replaced, and the desulfurization process is then restarted with the fresh sorbent. Note, however, that in such a conventional approach, the area above the curve 21 in period II of FIG. 3 would represent unused sorbent, which is one of the reasons that such a conventional process is not very efficient.

To address this problem according to this invention, the mass of sorbent material 20 is divided into a plurality of separate beds, e.g., beds 1-5 in FIG. 3, and at least one additional bed, e.g., bed 6, is provided in reserve. As mentioned above, the specific number of beds is not critical, although more beds will enable finer tuning of the process, i.e., to minimize the amount of "idle" sorbent 20 above the curve 21, which, as mentioned above, is a cause of inefficiency in conventional adsorbent desulfurization processes. However, more beds will also require more complex apparatus. Dividing the sorbent material 20 into an infinite number of beds would theoretically eliminate all idle sorbent capacity and achieve one hundred percent utilization of all the sorbent 20 capacity one hundred percent of the time. However, an infinite number of beds, of course, is impossible. Therefore, a balance has to be made between the number of beds desired for efficient use of the sorbent and the practical limitations of complexity and expense of the apparatus required, as will become more apparent in the description of the apparatus below. The six beds 1-6 illustrated in FIG. 3 will suffice to explain some of the principles of the invention.

In this illustration, some imagination is required to visualize the fuel flowing sequentially through the individual beds 1-5, while the length of flow through each bed, when added together, comprises the cumulative bed length 26. As illustrated in period I of FIG. 3, the "breakthrough" point 44' for bed 4 is at the beginning of bed 5. Therefore, the fuel flow 50 out of the back bed 5, i.e., the last bed in the desulfurization series, still has all of the sulfur removed, or removed at least to a desired maximum sulfur concentration threshold in the desulfurized fuel.

Eventually, the front bed 1 will reach saturation and breakthrough 44 will occur in the back bed 5, as shown in the end of period II. At or just before that point in time, the reserve bed 6 is moved into the desulfurization series after bed 5, as indicated by arrow 52 in period III, and the saturated bed 1 is moved out of the desulfurization series, as indicated by arrow 54. Therefore, bed 2 becomes the front bed and bed 6 becomes the back bed. The addition of bed 6 to the back or end of the series of beds in the desulfurizing mode or phase effectively pushes or moves the sulfur concentration curve 21 in period III to return to the position it occupied in period I with the additional, albeit temporary, capacity provided by bed 6 so that the breakthrough point 44 is in front of the out-flow 50 of the desulfurized fuel. As bed 6, along with the remaining cumulative capacity of beds 2-5, continues to desulfurize the fuel flow in period III, the sorbent in bed 1 is regenerated by desorbing and removing the sulfur from it. The regenerated bed 1 is then held in the reserve position 56, ready to be placed or switched into the sequence behind bed 6, when breakthrough occurs in bed 6. Therefore, as this desulfurization-regeneration cycle continues, the beds can be "visualized" as moving in a sequential rotation counter to the direction of the fuel flow 23. In an actual implementation, the beds could actually be moved physically into and out of the desulfurization and regeneration phases of the cycle and moved in series through each of those phases. However, it is preferred to simulate such bed movement with a valve arrangement, a preferred embodiment of which will be described below.

Because this invention uses a sorbent that can be easily regenerated and reused through an indefinite, or at least very large number of cycles, without significant loss of capacity, as explained above, this process illustrated in FIG. 3 continues with reserve beds being rotated into the sequence at or before breakthrough of sulfur from the preceding bed in the desulfurization series or sequence, and the saturated beds are rotated out of the sequence to be regenerated and readied for rotation back into the sequence. Rotate and rotation in this context does not mean that the beds have to be moved physically, although they can be, as will become clear from the descriptions below. In this context, rotate means either proceeding or switching in sequence, as will also become more clear from the description below. Therefore, as the sequential rotation or switching continues, a steady flow 50 of desulfurized fuel is produced. The continuous cycling of beds in this arrangement allows the sorbent in each bed segment to reach its equilibrium capacity with the sulfur concentration in the untreated fuel. Thus, the process reduces, if not eliminates, the sorbent use inefficiency that is unavoidable in conventional single bed approaches as explained above.

As mentioned above, the sorbent 20 for this invention does not have to be one having the best sulfur sorbing capacity, as long as it has some sorbent capacity and can be regenerated repeatedly. It is preferred that the sorbent material be one with the highest sulfur sorbing capacity that can also be regenerated through an indefinite number of sorption-regeneration cycles with negligible loss of capacity. Another desirable factor is that the sorbent material can be regenerated in a cost-effective manner.

Palladium supported on a high surface area refractory material is the preferred sorbent material, and a number of others also have enough of these characteristics to also be used in this invention. Silica and silica gel are porous, high surface area materials, which work in this invention with or without metal coatings, and any metal coating will work, although palladium and the other noble metals appear to work the best. Platinum and rhodium on high surface area silica also appear to be good candidates for sorbent materials for use in this invention. High surface area means at least 100 $m^2/g$ (square meters per gram). Of course, even higher surface area, such as at least 300 $m^2/g$, is preferred, and at least 600 $m^2/g$ is even more preferred. In general, the higher the surface area, the better the sorbent capacity. However, stability of the support structure and the related surface area might go down with higher surface areas for some materials. Stability depends on the chemical nature of the support material and the environment to which it is subjected during regeneration. For instance, some mesoporous materials like MCM-41 are not stable at temperatures above about 500° C. in the presence of steam. Also, high surface area usually means smaller pore sizes, which can be occluded by large sulfur containing molecules, as is the case with small pore zeolite structures like ZSM-5. Therefore, it is believed that surface areas of more than 2,000 $m^2/g$ may be detrimental to the rapid cycle, desulfurization-regeneration processes of this invention. In reality, it is possible and perhaps even probable, that some of the metal could be oxidized, especially in the heated, high oxygen environment created in the regeneration step, even if it starts in a reduced state. Thus, the palladium could oxidize and create at least some palladium oxide, and oxidation of platinum and rhodium can occur in the same manner. Copper is easily oxidized, thus almost certainly is in the form of copper oxide when used as a sorbent in an air or oxygen regeneration process of this invention. Therefore, when palladium, platinum, rhodium, copper, and other metals are mentioned or claimed as sorbent materials for use in air or oxygen regeneration processes of this invention, it is presumed that the oxides of those metals are included at least to some extent. In embodiments of this invention that include hydrogen or other reducing agents in the regeneration phase, such as at the end of the regeneration phase, metal could begin the desulfurization phase in its reduced form and then be oxidized in the beginning of the regeneration phase when it is exposed to hot air. However, the supported metals used as sorbents in this invention do not include salt forms of the metals, such as metal nitrates, or metal chlorides.

Silica, silica gel, alumina, activated carbon, and other high surface area support materials can be coated with palladium or other metals in a number of ways, including, for example, by wet impregnation, in which a metal salt, such as $Pd(NO_3)_2$, is dissolved in water and used to soak particles of silica, silica gel, or other support materials. The silica, silica gel, or other support material can then be dried, which results in a palladium or other metal coating on the silica, silica gel, or other support material, as will be described in more detail below.

In general, while metals and zeolites have not been eliminated as sorbents for use in this invention, the oxides, such as silica, alumina, and copper oxide, appear to be the most regenerable materials. Zeolites appear to be the highest capacity sorbents for liquid phase desulfurization of fuels, although preparation and activation is difficult, and regeneration characteristics have so far not matched the oxides. Copper and silver exchanged zeolites may show improvements in this regard, but base (i.e., reduced) metals and metal oxides, including oxides of transition metals, and particularly group VIII transition metals, for example palladium, provide wider operating and regenerating capabilities, as well as longer lifetimes through more adsorption-regeneration cycles.

Regeneration can be accomplished in a number of ways, including liquid solvents to remove the sulfur from the sorbent material, although oxidation of the sulfur to a gaseous effluent has a number of advantages. Air can be used to desorb sulfur species and to oxidize sulfur species to sulfur dioxide, which can be exhausted into the atmosphere. The sorbent bed can be heated to improve the oxidation as well as evaporation of the sulfur species, thereby to enhance regeneration. For example, marine diesel fuel with 7,800 ppm sulfur using palladium supported on silica, which showed desulfurization to less than 5 ppm sulfur, and regeneration has been demonstrated with air in a sorbent bed heated to about 500° C. with good stability. A temperature of 500° C. appears to be better than 400° C., although regeneration at a temperature as low as 400° C. has been demonstrated and batch regeneration as high as 800° C. has been shown. In general, temperatures higher than 500° C. will require shorter regeneration times, and temperatures lower than 500° C. will require longer regeneration times. Desulfurization of fuel with 1,000 ppm sulfur to less than 2 ppm followed by air regeneration has also been demonstrated. Successful removal of thiophene and dibenzothiophene (molecules comprising sulfur) from surrogate fuels, e.g., hexane and a hydrocarbon mixture representing JP-8 was demonstrated using copper oxide on silica as the sorbent. (JP-8 is jet fuel, basically kerosene, military specification MIL-T-83133.) Both liquid and vapor phase desulfurization were demonstrated, and less than 1 ppmw (part per million by weight) of sulfur in the surrogate fuel was produced. Although the capacity of the sorbent is lower than copper exchanged zeolite Y, the copper oxide on silica sorbent is very stable in air and is easily regenerable. Regeneration of the sorbent was conducted by flowing air through the bed after measuring the desulfurization breakthrough curve. More than 20 adsorption-regeneration cycles with 300° C. air were demonstrated without loss of sorbent capacity. Regeneration was complete in less than 10 minutes. The capacity of these sorbents described above is good, although less than non-regenerable materials, such as copper exchanged zeolite. However, the effect of lower capacity is offset by the frequent regeneration and maximizing the sorbent use efficiency, according to this invention.

Reduction of the thiophenes and dibenzothiophenes using hydrogen to desorb the sulfur from the sorbent materials for regeneration, producing hydrogen sulfide gas, can also be used instead of, or in addition to, oxidation. Hydrogen gas may be available, for example, from tail gas from fuel cell reactions. The reduction process can be done with the same equipment as the air regeneration.

As mentioned above, the method of this invention can be implemented in a variety of ways with various different bed, plumbing, and valving apparatus. However, for simplicity, a moving bed or simulated moving bed arrangement is a very convenient and effective apparatus for this invention. The process described above in connection with FIG. 3 is an example of a simulated moving bed process, i.e., one in which the sorbent effectively "moves" counter to the fuel flow. In the example of FIG. 3, the beds 1-6 are finite portions of the sorbent bed 20. While it is possible to actually move the beds, such movement can also be simulated by valved plumbing that directs fluids into and out of the beds in sequences that effectively "move" the sorbent beds counter to the fuel flow, even though the beds actually remain physically stationary. A schematic diagram of how to implement a simulated moving bed arrangement is shown in FIG. 4 depicting six sorbent beds 1-6 for continuity with the example illustration in FIG. 3 described above.

Figure 4:
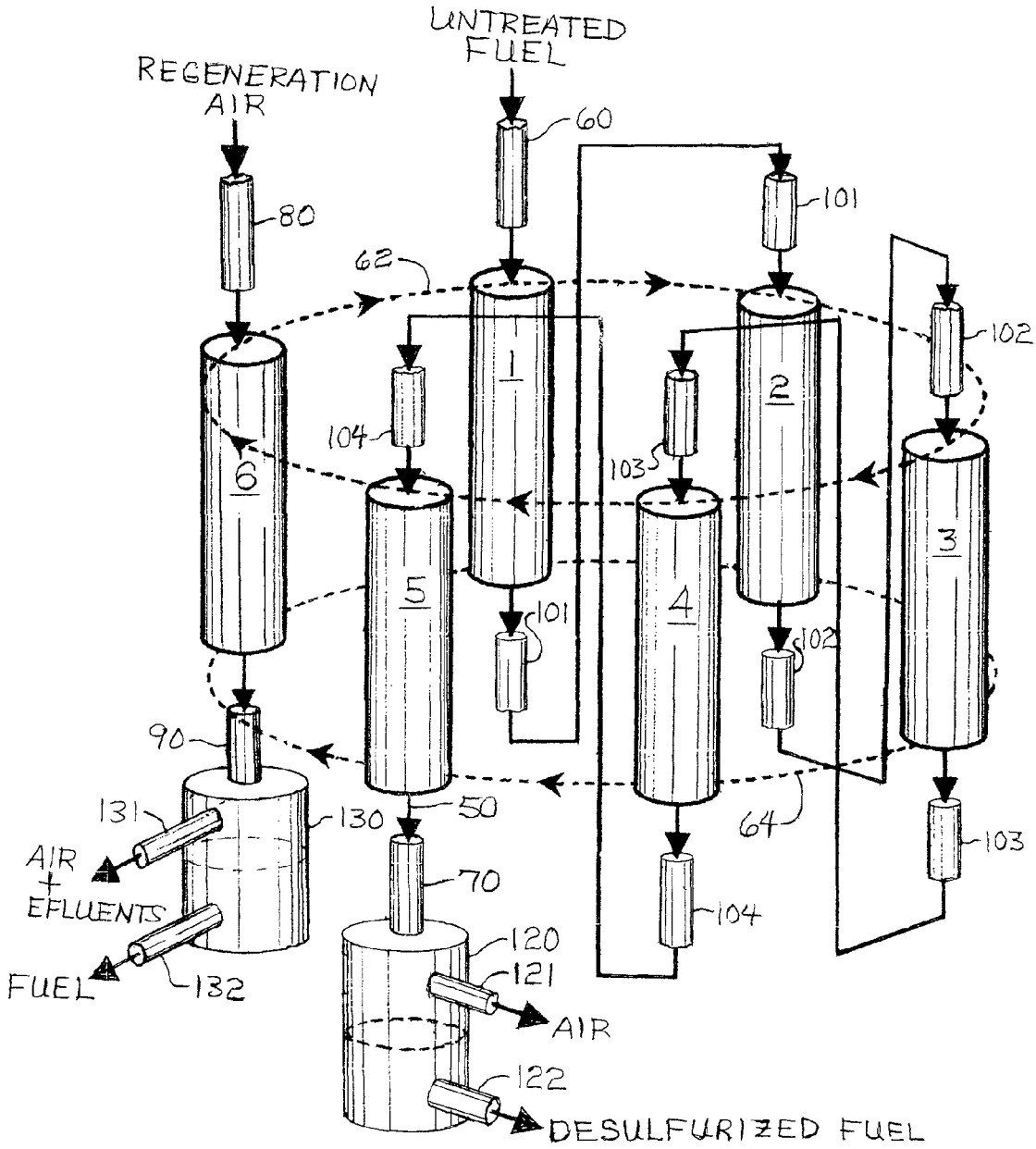
FIG. 4 is a diagrammatic view of a simplified depiction of the rapid cycle desulfurizer apparatus of this invention.

In FIG. 4, the six example sorbent beds 1-6 are depicted as being physically fixed or immoveable, while the plumbing and valves enact the "movement" or "rotation" of the beds 1-6 as described above in relation to FIG. 3. The inlet conduits 60, 80, outlet conduits 70, 90, and connecting conduits 101, 102, 103, 104 are illustrated as being rotatable in relation to stationary beds 1-6, as indicated by the arrows 62, 64. The inlet conduit 60 directs untreated fuel into the beds, and conduit 70 carries desulfurized fuel out of the beds. The inlet conduit 80 directs regeneration gas, such as air in an oxidation regeneration or hydrogen in a reduction regeneration, into the bed that is being regenerated, while outlet conduit 90 exhausts the regeneration gas from the bed that is being regenerated. The beds 1, 2, 3, 4, 5 are connected in series to each other by respective conduits 101, 102, 103, 104, so that the fuel flows from the bottom of bed 1 to the top of bed 2, from the bottom of bed 2 to the top of bed 3, from the bottom of bed 3, to the top of bed 4, and from the bottom of bed 4 to the top of bed 5. The terms bottom and top are relative to the flow direction of the fuel and do not mean that the beds have to have any particular vertical, horizontal, or other orientation.

Of course, it is also feasible to hold the conduits stationary and move the beds 1-6 instead and still accomplish the same desulfurization-regeneration process. For this illustration in FIG. 4, however, the untreated fuel is shown flowing into the top of the sorbent bed 1, as indicated by arrow 66. Beds 1 through 6 are full of sorbent material. After flowing through the sorbent in bed 1, the fuel flows through conduit 101 to bed 2. Likewise, the fuel continues to flow in series or sequential order through bed 2, conduit 102, bed 3, conduit 103, bed 4, conduit 104, and bed 5. As this flow continues, the fuel is desulfurized by the sorbent in the series of beds 1-5, as explained above in relation to FIG. 3. The desulfurized fuel flow 50, along with some residual air from the beds 1-5, is directed by the outlet conduit 70 into a separator container 120, where the residual air is separated from the desulfurized fuel. The air flows from the top of the separator 120 out the exhaust pipe 121, and the desulfurized fuel flows from the bottom of the separator out the product pipe 122.

As explained above in relation to FIG. 3, when breakthrough occurs or is about to occur in bed 5—the last in the series of the five beds 1-5, the bank of conduits 60, 70, 80, 90, 101, 102, 103, 104 is rotated in unison in the direction of arrows 62, 64 to effectively move the reserve bed 6 into the end of the series of actively operating desulfurizing beds 2-6 by connecting it to the conduit 104 and outlet 70 and to effectively shift the sulfur-saturated bed 1 out of the desulfurization series of beds and into the regeneration and reserve position in connection with inlet conduit 80 and outlet conduit 90. In the same rotation, the fuel inlet 60 is shifted from bed 1 into connection with bed 2, and the conduits 101, 102, 103, 104 are shifted to connect bed 2 to bed 3, bed 3 to bed 4, bed 4 to bed 5, and bed 5 to bed 6, respectively. While the series of connected beds 2-6 continue to desulfurize the fuel, bed 1 in the reserve position receives regeneration air from inlet 80, which desorbs and oxidizes the sulfur containing molecules that were adsorbed from the fuel by the sorbent material in bed 1. Such desorption and oxidation regenerates the sorbent material, and the sulfur in the form of organosulfur molecules and sulfur oxides is exhausted with the air from bed 1 through the outlet 90. Therefore, bed 1 gets regenerated and made ready for the next shift into the series of desulfurizing beds behind bed 6.

Then, when sulfur breakthrough occurs or is about to occur in bed 6, the conduits 60, 70, 80, 90, 101, 102, 103, 104 are rotated again, as described above, to shift the regenerated bed 1 out of reserve and into the series of desulfurizing beds behind bed 6, while bed 2 is shifted to reserve for regeneration. This process continues indefinitely to provide a flow of desulfurized fuel 50.

The desulfurized fuel flow 50 from the last bed in the desulfurizing bed series will be accompanied by some residual air from the recently regenerated bed in the series. Therefore, the desulfurized fuel flow 50 can be directed to a separator 120, where the residual air is separated from the desulfurized fuel and exhausted through pipe 121, while the desulfurized fuel flows out of the product pipe 122. Such separator methods and apparatus are well-known to persons skilled in the art and need not be explained in detail here.

The exhaust air and sulfur containing effluent in outlet 90 from the bed being regenerated will also be accompanied by residual fuel from that bed. Therefore, another separator 130 can be provided to separate the exhaust air and sulfur species from the residual fuel. The residual fuel will still have a high concentration of sulfur, because it is from a saturated bed, so it can be piped through return pipe 132 back to be mixed with the untreated fuel to go back into the desulfurization process, while the air and sulfur-containing effluent is exhausted through the exhaust pipe 131. In addition to sulfur oxides, the effluent may also contain vaporized thiophenes as dibenzothiophenes and other materials.

As mentioned above, the desorption process during regeneration is aided by high temperature, which can be provided in a number of ways. One of those ways is to heat the bed that is being regenerated with electric heat, although other heat sources, such as from a catalytic reaction of a fuel reformer, tail gas combustion from fuel cells, and the like. For simplicity, electric heat is used in this description, such as the electric heaters 150 wrapped around the sorbent beds 1-12 shown in FIGS. 1 and 2 with suitable controllers (not shown) for turning the heaters 150 on and off individually. Such electric heaters and controllers are well-known and readily available on the market, for example from Thermcraft, Inc., Winston-Salem, North Carolina (www.thermcraft.com), thus need not be described in detail here for an understanding of this invention. The electric power/control cords 152 for the heaters 150 are shown diagrammatically in FIGS. 1 and 2.

Figure 5:
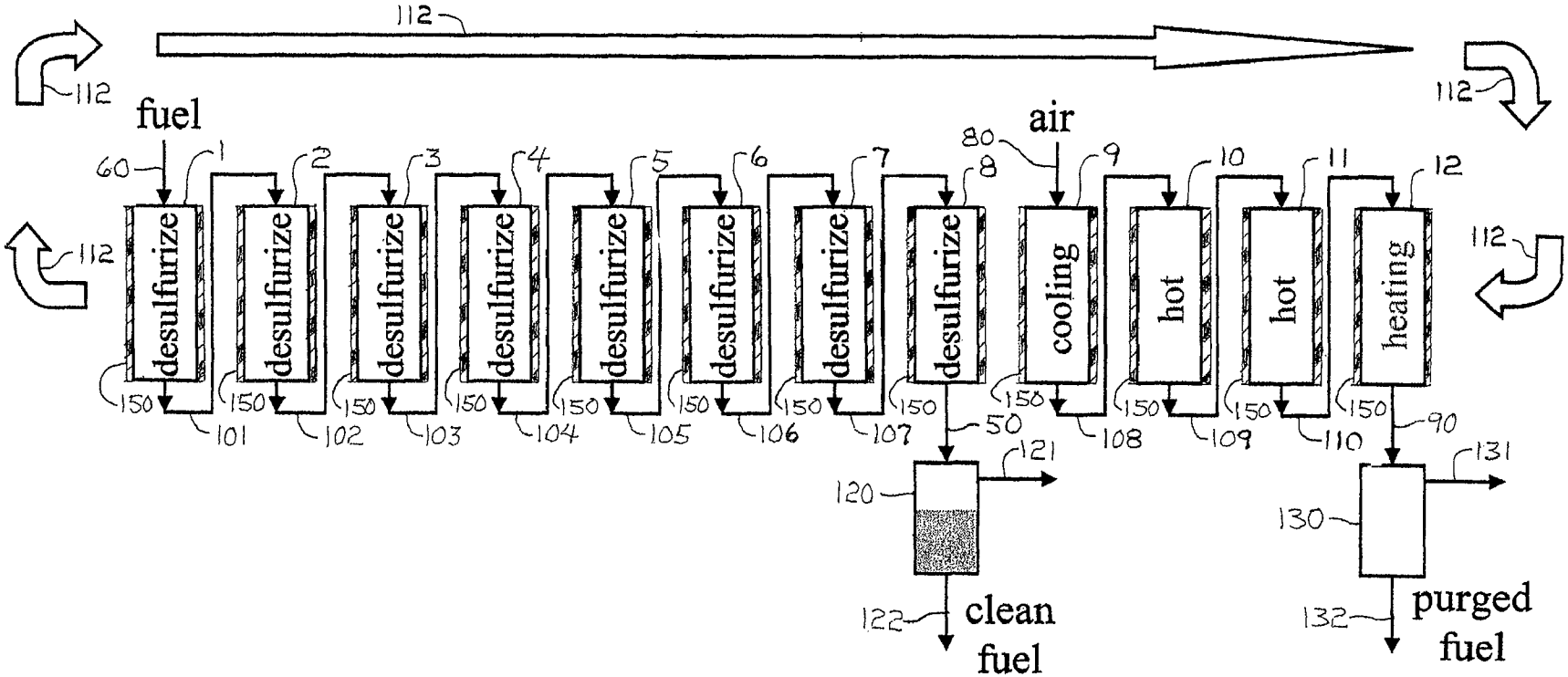
FIG. 5 is a schematic diagram of the rapid cycle desulfurization-regeneration process of the invention with eight beds in various stages of the desulfurization phase and four beds in various stages of the regeneration phase.

Referring now to FIG. 5, several additional beds 7, 8, 9, 10, 11, 12 are added to the previously described diagrammatic representations of FIGS. 3 and 4 to illustrate one preferred method for handling the heating and cooling of the sorbent beds during the regeneration stage of the desulfurization-regeneration cycles. In this illustration in FIG. 5, there are eight beds 1-8 shown in the desulfurization series instead of the five shown in FIGS. 3 and 4, but they function in the same manner with the untreated fuel flowing into the first bed 1 in the series of beds 1-8 through the inlet 60, and the desulfurized fuel 50 flowing out of bed 8 into the separator 120. The heaters 150 on these beds 1-8 in the desulfurization portion of the desulfurization-regeneration cycle are turned off. In the example of FIG. 5, there is a plurality of beds, e.g., beds 9, 10, 11, 12, in the regeneration portion of the desulfurization-regeneration cycle. Of these four beds 9-12, the last three, e.g., beds 10, 11, 12, have the heaters 150 turned on, while the heater 150 on bed 9 is turned off. In the rotation illustrated by arrows 110, which occurs when there is sulfur breakthrough in the fuel out-flow 50 at the end of the last bed in the desulfurization bed series, the bed 12 in FIG. 5 is full of saturated sorbent material and fuel that still has high sulfur concentration, as also explained above. Therefore, the heater 150 on bed 12 is turned on to start heating the sorbent material in bed 12.

In the meantime, the heaters on beds 10 and 11 are already turned on, and the sorbent in those beds 10 and 11 is hot enough to desorb and oxidize the thiophene and dibenzothiophene molecules that contain the sulfur adsorbed from the fuel when those beds were in the desulfurization phase of the desulfurization-regeneration cycle. Cool air flows through inlet 80 into bed 9, which has its heater 150 turned off. The sorbent material in bed 9 has already been regenerated, so the cool air tends to cool the sorbent in bed 9 to prepare it for its next rotation into the end of the desulfurization phase. The heat removed from bed 9 by the air also preheats the air, which continues to flow through connecting conduits 108, 109 into the hot beds 10, 11, where the air gets even hotter to desorb and oxidize the sulfur from the sorbent material in those beds, as described above. From bed 11, the hot air and sulfur species from the regenerated beds 10, 11 flows through connector conduit 110 into bed 12, where it helps to heat the sorbent material in bed 12 and purges the high sulfur concentration fuel out of bed 12 through outlet 90 into the separator 130.

Of course, at or just before sulfur breakthrough in the clean fuel flow 50 at the end of bed 8, the regenerated bed 9 will be rotated into the end of the desulfurization series of beds next to bed 8 as the first bed in the desulfurization series, e.g., bed 1, is rotated as indicated by arrows 112 to the beginning of the regeneration stage to replace bed 12. Bed 12 shifts to the position of bed 11, while bed 11 shifts to the position of bed 10, and bed 10 shifts to the cooling position of bed 9. Likewise, as explained above, the beds 2-8 shift or advance in positions in the desulfurization series of beds. As the desulfurization-regeneration cycle continues through successive rotations, a steady flow of clean, desulfurized fuel continues to flow out of the apparatus.

Turning now to the preferred rapid cycle, simulated moving bed apparatus 100 illustrated in FIGS. 1 and 2 for performing the continuous desulfurization-regeneration cycles described above, this example apparatus 100 is also shown with twelve beds 1-12, which can function the same as beds 1-12 in FIG. 5 described above. Any number of beds greater than one can be used, but ten to 20 beds are feasible and provide desirable efficiencies in sorbent usage. The beds 1-12 in FIGS. 1 and 2 are stationary and mounted on an annular platform 160 and stabilized by an annular plate 162. In the example apparatus 100, eight of the twelve beds are used in the desulfurization series, and four of the twelve beds are used in the regeneration series, which is the same as illustrated in FIG. 5. These bed assignments could be varied with more or fewer beds in either or both of the desulfurization series and regeneration series, as required for the most efficient use of the particular sorbent material being used. For example, a sorbent material with higher capacity, but more difficult to regenerate, might require seven of the twelve beds in the desulfurization phase and five of the beds in the regeneration phase. Conversely, a lower capacity, but easily regenerable sorbent material, might require more of the beds to be in the desulfurization phase and fewer beds in the regeneration phase.

Figure 7:
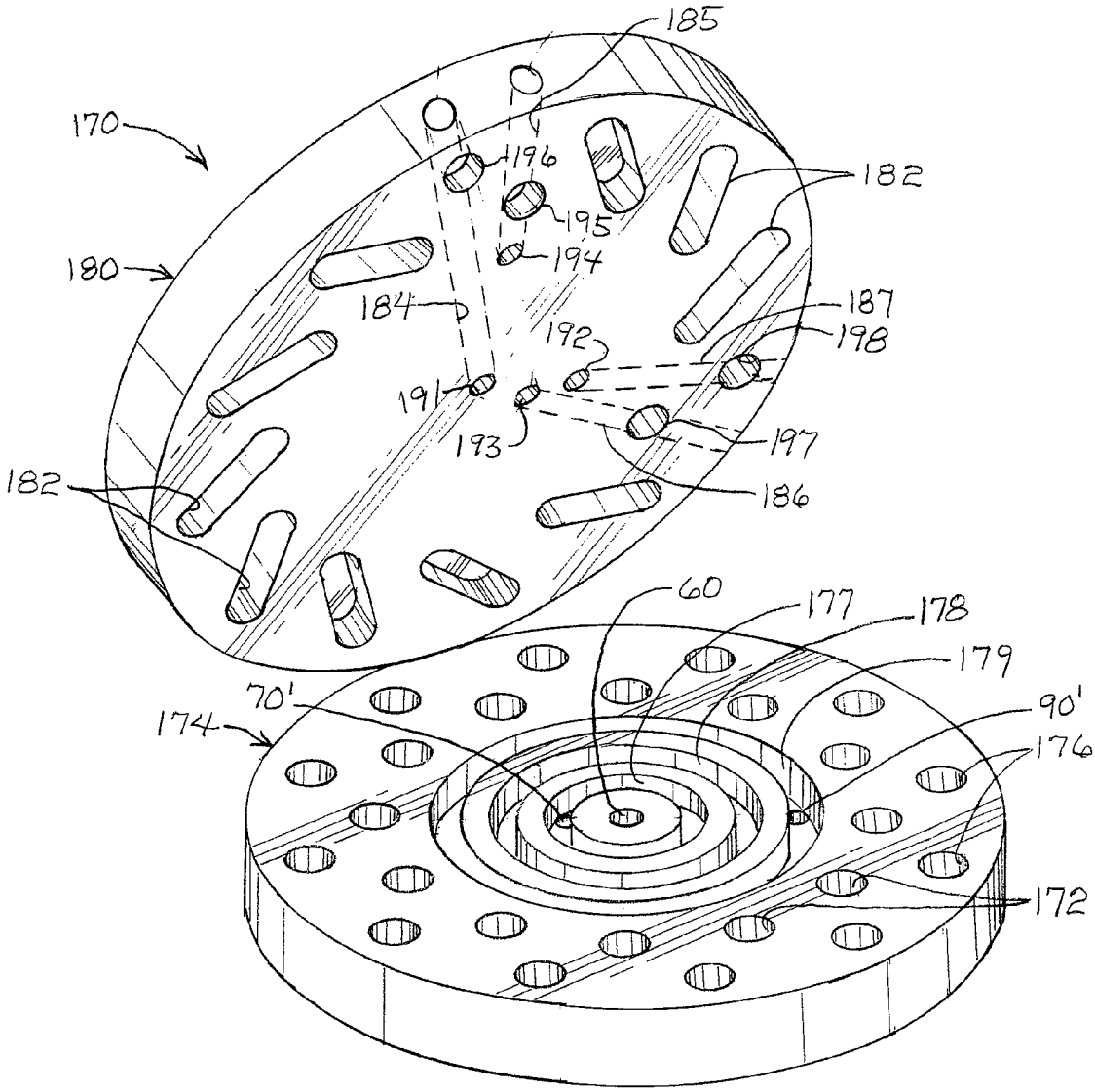
FIG. 7 is a perspective view of the orifice plate and the valve shoe separated to reveal their respective interfacing ports, channels, holes, and ducts that function to direct fuel and regeneration fluid into and out of individual absorbent beds.
Figure 8:
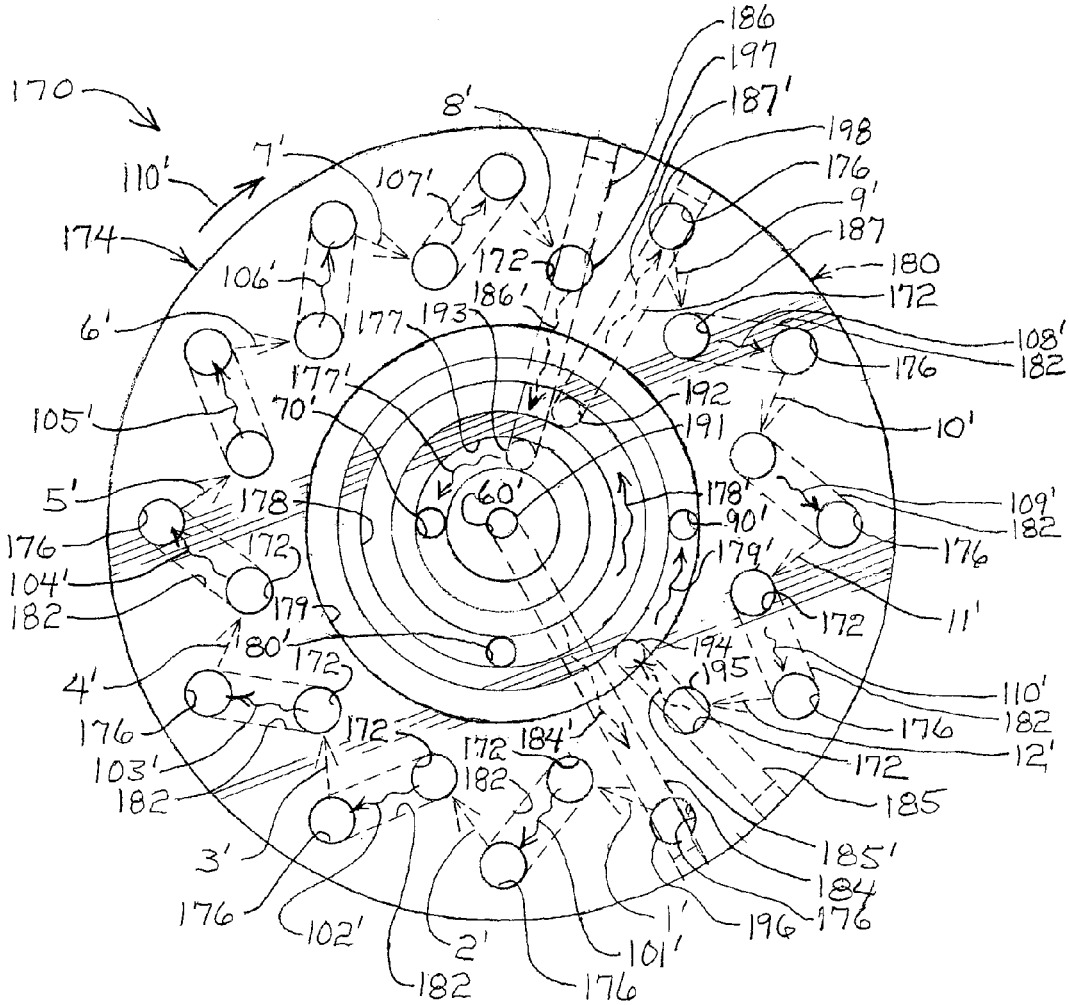
FIG. 8 is a plan view of the surface of the orifice plate with the interfacing holes and connecting ducts of the valve shoe superimposed over the surface in phantom lines to illustrate the functional relationship between the orifice plate and the valve shoe.

The rotation of beds 1-12 into and out of the desulfurization and regeneration phases of the cycle and advancing the beds from back to front within those phases is performed in the rapid cycle apparatus 100 by a rotating valve apparatus 170 operated by any rotary drive mechanism or motor 164, for example, a stepper motor 164. The untreated fuel inlet 60, desulfurized fuel outlet 70, regeneration gas inlet 80, and regeneration gas outlet 90 are numbered the same and perform the same functions in apparatus 100 are the same as described above for FIGS. 4 and 5. The FIGS. 1 and 2 are too crowded to show individually the numbers for each of the conduits that connect the beds 1-12 in series, so suffice it to say that the tops of the beds 1-12 are each connected individually by individual conduits 140 to the rotating valve apparatus 170, and the bottoms of beds 1-12 are each connected individually by individual conduits 142 to the rotating valve apparatus 170. The conduits 142 extend from the bottoms of beds 1-12, through the center opening in annular platform 160 and upwardly between beds 1-12 and into the bottom of the rotating valve apparatus 170, where they connect to individual ones of the inner ports 172 in the stationary orifice plate 174 of the rotating valve apparatus 170, which are best seen in FIGS. 7 and 8. The tops of the beds 1-12 are connected by conduits 140 to individual ones of the outer ports 176 in the stationary orifice plate 174. Various channels 182 and ports in the rotatable valve shoe 180 serve to shift flows among the various ports 172, 176 in the orifice plate 174 to effect the simulated "rotation" of the beds 1-12 into, through, and out of the various phases of the desulfurization-regeneration cycle that were described above in relation to FIGS. 3-5. The interfacing surface of the valve shoe 180 is preferably graphite, and the interfacing surface of the orifice plate is preferably hardened steel, although alternate valve constructive materials may include silicon carbide, alumina, and other ceramics. At least one self-lubricant material is preferred, and a metal orifice plate 174 is preferred for simplifying connections between ports 172, 176 and the conduits 140 and 142. Of course, the planar geometry of the valve is not essential. Other kinds of rotating valves could also be used for the method of this invention.

The rotating valve apparatus 170 comprises the stationary orifice plate 174 and the rotatable valve shoe 180 enclosed within a valve housing 168 (FIG. 1). A gear 183 (FIG. 6) or other drive mechanism on the rotatable valve shoe 180 is engaged by the stepper motor 164 (FIG. 1) for rotating the valve shoe 180 in relation to the stationary orifice plate 174. The concentric annular channels 177, 178, 179 in orifice plate 174 in conjunction with ducts 184, 185, 186, 187 bored radially into valve shoe 180, and holes 191, 192, 193, 194, 195, 196, 197, 198 in valve shoe 180 connect fuel inlet 60, fuel outlet 70, regeneration gas inlet 80, and regeneration gas outlet 90 into and out of the beds 1-12. After boring, the radially outward ends of ducts 184, 185, 186, 187 are plugged.

Figure 6:
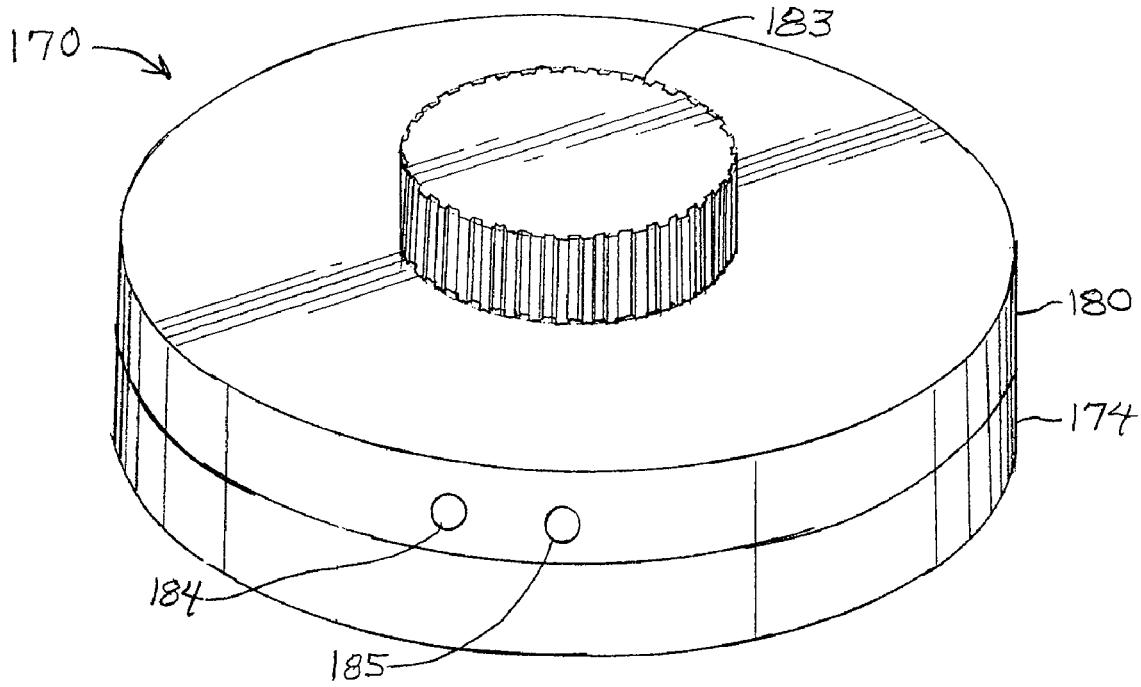
FIG. 6 is an isometric view of the two primary components of the rotary valve used in the example rapid cycle desulfurization apparatus in FIG. 1, i.e., the stationary orifice plate and the rotatable valve shoe, assembled together.

To explain how the rotating valve 170 directs the fuel and regenerating air into and out of the beds 1-12, primary reference is made now to FIG. 8 with secondary reference to FIGS. 1 and 7. FIG. 8 is a top plan view of the stationary orifice plate 174, and the phantom lines superimposed over the surface of orifice plate 174 correspond to the valve slots 182, holes 191-198, and ducts 184-187 of the rotatable valve shoe 180 when the valve shoe 180 is seated on top of the orifice plate 174 as shown in FIG. 6. The phantom arrows 1'-12' represent fuel flow and regenerating air flow through the respective beds 1-12.

Again, keeping in mind the principles shown by the diagrammatic views of FIGS. 4 and 5, the rapid cycle desulfurizer apparatus 100 of FIGS. 1-2 and 6-8 is illustrated with eight of the twelve beds 1-12 assigned to the desulfurization phase and four of the beds 1-12 assigned to the regeneration phase. The initial position of the rotatable valve shoe in FIG. 8 corresponds to beds 1-8 being in the desulfurization phase with beds 9-12 in the regeneration phase. The untreated fuel inlet conduit 60 (FIGS. 1 and 4) is connected to the axial port 60' of the orifice plate 174. This axial port 60' is connected by a hole 196 in valve shoe 180 to the duct 184 in the rotatable valve shoe 180, and the duct 184 is connected to an outer port 176 to flow the untreated fuel as indicated by arrow 184' into a conduit 140 (FIG. 1) to the top of bed 1. From there, the fuel flows as indicated by phantom arrow 1' in FIG. 8 through bed 1. From the bottom of bed 1, the fuel flows through one of the conduits 142 back to the corresponding inner port 172 in the stationary orifice plate 174 of the rotating valve 170 (FIG. 8). From that inner port 172, one of the diagonal channels 182 in the rotatable valve shoe 180 directs the fuel flow to the next adjacent outer port 176, as indicated by arrow 101'. From that outer port 176, the fuel flows through a conduit 140 (FIG. 1) to the top of bed 2. Phantom arrow 2' (FIG. 8) indicates the fuel flowing through bed 2. In this manner, the series of diagonal channels 182 direct the fuel flow from the bottom of one bed to the top of another, as indicated by flow arrows 101', 102', 103', 104', 105', 106', 107' to flow sequentially through the beds 1-8, as indicated by phantom arrows 1', 2' 3', 4', 5', 6', 7', 8' for the desulfurization phase.

The desulfurized fuel from the bottom of the last bed in the desulfurization series, e.g., bed 8, flows through a conduit 142 to the next inner port 172 in the stationary orifice plate 174. The hole 197 in the rotatable valve shoe 180 is aligned with the inner port 172 and directs the desulfurized fuel from the inner port 172 into the radial duct 186 in the valve shoe 180. The radially inner end of the duct 186 is connected by a hole 193 in the valve shoe 180 to the inner annular channel 177 in the stationary orifice plate 174, regardless of the angular rotation of the valve shoe 180 in relation to the stationary orifice plate 174. A fuel outlet port 70' in the inner channel 177 is connected to the desulfurized fuel outlet conduit 70 (FIGS. 1 and 4), so that the desulfurized fuel flows through the duct 186 and inner channel 177, as indicated by arrows 186', 177', respectively, to the outlet conduit 70, regardless of the angular rotation of the valve shoe 180 in relation to the stationary orifice plate 174.

Of course, rotation of the valve shoe 180, as indicated by arrow 110 in FIG. 8, does advance the duct 184 and hole 196 in the valve shoe 180 to align with the next outer port 176 and thereby to switch or advance the flow of untreated fuel from bed 1 to flow into the next bed 2, as described above, while the same rotation switches the hole 197 and duct 186 to receive desulfurized fuel flow from the next bed 9 instead of bed 8. For the 12-bed desulfurizer apparatus shown in FIG. 8, the valve rotation may be thirty degrees (30°) for each incremental valve advancement, although other arrangements could be used. Therefore, continuing sequential, intermittent rotation 110' of the valve shoe 180 effectively advances the various functional stages of the desulfurization process from one bed in a series to another, as the first bed in the series saturates with sulfur, in order to maintain a continuous flow of desulfurized fuel, as explained above and indicated by arrow 112 in FIG. 5.

The rotary valve 170 also handles advancing the functional stages of the regeneration process from one bed to another in a series of beds being regenerated. Referring again primarily to FIGS. 7 and 8, the valve shoe 180 is shown in a position to direct regeneration fluid, such as air, into bed 9, which at this rotational position is the first bed in the regeneration series of beds 9-12. Specifically in this example, regeneration gas is directed from the regeneration gas inlet 80 (FIGS. 1 and 4), which is connected by a port 80' in orifice plate 174, into the middle annular channel 178 in orifice plate 174. A hole 192 in valve shoe 180 connects a radial duct 187 in the valve shoe 180 to the middle annular channel 178, and another hole 198 connects the radial duct 187 to an outer port 176 in orifice plate 174. Therefore, in the position and example shown, the regeneration gas flows from port 80', through the middle annular channel 178, as indicated by arrow 178', through the radial duct 187, as indicated by arrow 187', to the outer port 176 that is connected by a conduit 140 (FIG. 1) to the top of bed 9.

The flow arrow 9' represents the flow of regeneration air through bed 9. As explained above, the regeneration air flow is counter, i.e., in the opposite direction, to the effective progression of the beds 9-12 in the sequence of the example regeneration phase. Therefore, the sorbent in bed 9 in this example is fairly well regenerated and has very little sulfur left in it, and the heater around bed 9 is turned off. The flow of fresh regeneration air through bed 9 helps to cool the sorbent material in bed 9, and the heat from bed 9 helps to heat the regeneration air, as explained above in relation to FIG. 5. Then, as illustrated in FIG. 8 in conjunction with FIGS. 1 and 2, the regeneration air flows from the bottom of bed 9 and through one of the return conduits 142 back to the rotary valve 170, where the return conduit 142 is connected to an inner port 172 in the orifice plate 174. One of the diagonal channels 182 connects that regeneration air from the bottom of bed 9 to the top of the next bed in the regeneration series, e.g., to bed 10.

The heater 150 on bed 10 is turned on, so the sorbent in bed 10 is heated. The regeneration air flow through bed 10, as indicated by arrow 10' in FIG. 8, also gets heated to the desired desorption operating temperature as it flows through the hot sorbent bed. Therefore, the heat in the air and sorbent finishes the desorption and/or oxidation of sulfur containing molecular species in the bed 10, as explained above in relation to FIG. 5. The sulfur species removed by this process can include desorbed sulfur species as they existed in the raw fuel, partially degraded sulfur products, partially oxidized products, sulfur dioxide, or any combination of these species.

The heaters on beds 11 and 12 are also turned on, as explained above in relation to FIG. 5, and the hot air and sulfur exhaust products from the bottom of bed 10 are directed into the top of bed 11. The heat in bed 11 and the flow of hot air through bed 11, as indicated by arrow 11' in FIG. 8, drives the desorption and oxidation process.

To accomplish this flow direction, the bottom of bed 10 is connected by one of the conduits 142 (FIGS. 1 and 2) to the next inner port 172 in the orifice plate 174 (FIGS. 7 and 8). Another diagonal channel 182 in the valve shoe 180 directs the flow of hot air and regeneration sulfur containing exhaust effluents from that inner port 172 to the next outer port 176, as indicated by flow arrow 109'. That port 176 is connected by another one of the conduits 140 to the top of bed 11.

After the flow 11' of hot air and sulfur containing fluid through bed 11, the flow is directed from the bottom of bed 11 to the top of bed 12, which, being the most recent bed switched from the desulfurization phase into the regeneration phase, is still saturated with sulfur and full of high sulfur concentration fuel. This flow direction is accomplished by another one of the conduits 142 (FIGS. 1 and 2) connected between the bottom of bed 11 to the next inner port 172 in the orifice plate and then by another one of the diagonal channels 182 in valve shoe 180 connecting that inner port 172 to the next outer port 176. Therefore, the flow of hot air and sulfur containing regeneration effluents from bed 11 flows through the rotary valve 170, as indicated by arrow 110' in FIG. 8, and that outer port 176 is connected by another one of the conduits 140 (FIG. 1) to the top of bed 12.

As explained above, the flow of air and sulfur species through bed 12, as indicated by arrow 12' in FIG. 8, helps to purge the residual, high sulfur concentration fuel out of bed 12 and to heat the sorbent in bed 12. Therefore, the flow out of the bottom of bed 12, which is a mixture comprising air, sulfur species, and purged fuel, is directed by the rotary valve 170 to the outlet conduit 90 (FIGS. 1 and 5) for flow to the separator 130 (FIG. 5). Another one of the return conduits 142 connects the bottom of bed 12 to the next inner port 172 in orifice plate 174. A hole 195 in the valve shoe 180 (FIGS. 7 and 8) connects that inner port 172 to another radial duct 185 in the valve shoe 180, which directs the flow of air, sulfur dioxide, and purged fuel, as indicated by arrow 185', to the outer annular channel 179. The radial duct 185 is connected to the outer annular channel 179 by a hole 194 in the valve shoe 180. The outer annular channel 179 directs the flow, as indicated by arrow 179' to a port 90' in the orifice plate 174, and the outlet conduit 90 (FIGS. 1 and 5) is connected to that port 90'.

When the valve shoe 180 is rotated as indicated by arrow 110' in FIG. 8 to switch bed 1 out of the desulfurization phase and into the regeneration phase, as shown by arrow 112 in FIG. 5, holes 195, 196 of the respective ducts 184, 185 in valve shoe 180 advance to the next pair of outer and inner ports 176, 172 to make that switch. The same rotation 110' of valve shoe 180 also advances the holes 197, 198 of respective ducts 186, 187 to their next pair of outer and inner ports 176, 172 to switch the regenerated bed 9 out of the regeneration phase and into the desulfurization phase of the desulfurization-regeneration cycle. That orientation is maintained until the next sulfur breakthrough, when the valve shoe 180 undergoes another increment of rotation 110' to advance the hole pairs 195, 196 and 197, 198 in valve shoe 180 to align with their respective next outer and inner port pairs 176, 172 to switch bed 2 out of the desulfurization phase for regeneration and bed 10 into the desulfurization phase. This incremental rotation 110' of valve shoe 180 continues indefinitely to switch beds into and out of the respective desulfurization and regeneration phases of the cycle and to advance beds within those phases, as explained above, to provide a continuous flow of desulfurized fuel.

Any suitable controller can be used to control the drive mechanism 164 to rotate the valve shoe 180 in the above-described rotation increments 110', as is well within the capabilities of persons skilled in the art. Such incremental rotations can be timed based on empirical testing to prevent sulfur breakthrough for a particular apparatus size, shape of beds, number of beds, sorbent capacity, fuel flow rates, sulfur concentration in the untreated fuel, and other parameters such as desired maximum sulfur concentration in the treated fuel fraction of beds in respective desulfurization and regeneration phases, and the time and temperature required for regeneration, and the time and temperature used for regeneration. Alternatively, the clean fuel can be monitored for sulfur content on a real time basis, and the drive mechanism 164 can be activated to make an increment of rotation 110' whenever the sulfur concentration in the clean fuel either reaches or exceeds some desired maximum sulfur concentration threshold. Again, such controls are within the capabilities of persons skilled in the art, once they understand the principles of this invention. Also, as mentioned above, a preferred drive mechanism 164 comprises a stepper motor, although continuous rotating motor, servo motor, pneumatic motor, hydraulic motor, solenoid, or others can also be used.

The fraction of the beds providing desulfurization and the fraction of the beds undergoing regeneration in the apparatus 170 can be changed by changing the port and groove configuration of the valve shoe 180 without having to make any other modification to the orifice plate 174 or to the beds 1-12 or to the fluid connections between the beds 1-12 and the orifice plate 174.

Although the preferred embodiment of the invention described above and shown in FIGS. 1-8 utilizes oxidative regeneration, reduction can also be implemented in the same apparatus without any modifications other than feeding a reducing gas instead of air into the regeneration phase. Further, oxidation followed by reduction can also be used, although the mechanism would have to be a little more complex to route and switch the air and reducing gas sequentially into the beds. For example, an additional gas inlet and outlet would be needed, and the orifice plate would need additional grooves for the reducing gas inlet and outlet. The valve shoe would also require additional lines for the reducing gas inlet and outlet. Persons skilled in the art can easily make these additions to the apparatus, once they understand the principles of this invention. Also, as mentioned above, gas or liquid solvents can also be used to release and remove the sulfur species from the sorbent beds instead of, or in addition to, air.

Controls for turning the heaters 150 on and off are also readily available and adaptable by persons skilled in the art to this invention, once they understand the principles of this invention. Essentially, it is preferred that the heaters 150 are turned off during the desulfurization phase and during the last step of the regeneration phase and turned on during the steps of the regeneration phase where desorption and oxidation are required. However, the heaters 150 can be turned on to lower levels to maintain some desired minimum fuel temperatures in the desulfurization phase, such as in cold weather conditions and the like.

While the apparatus and process described above has utility for smaller beds and fuel flows, some modifications may be needed to provide faster and more efficient heating and cooling of the sorbent beds. For example, the air flow rate through the sorbent may be insufficient to cool the sorbent beds in a sufficient time, and electrically powered heaters may be an inefficient use of electric power generated by fuel cells operated with the desulfurized fuel produced by this invention. Therefore, a number of modifications may be made as needed to attain efficient heating and cooling of the sorbent beds.

Figure 9:
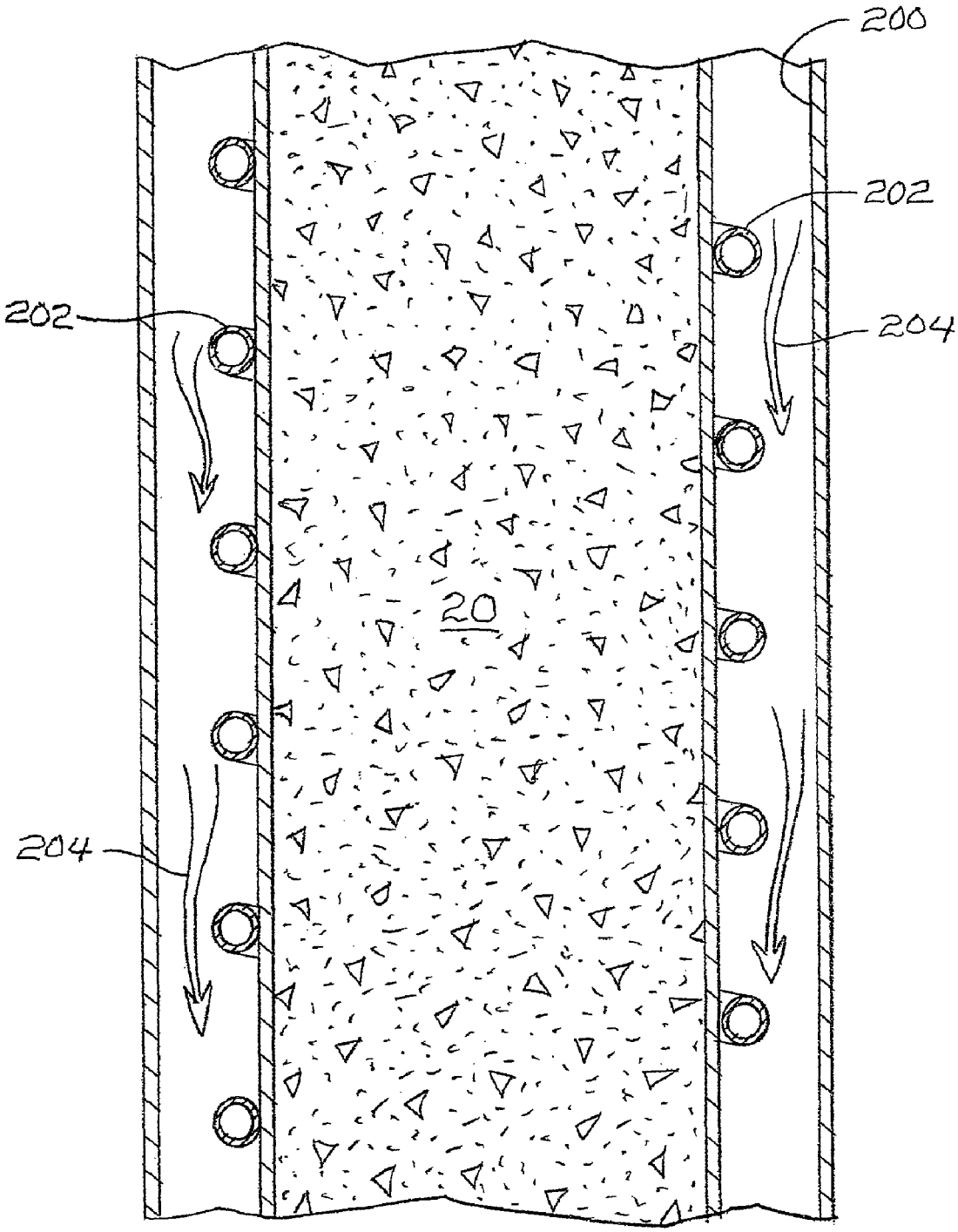
FIG. 9 is a cross-section view of a portion of an absorbent bed with alternative fluid heating and cooling structures.

For example, as shown in FIG. 9, the beds of sorbent material 20 could be surrounded by an enclosed annular duct 200 for carrying heating or cooling fluids, such as hot combustion gases or fluids carrying heat from combustion of untreated fuel or from heat produced by the fuel cells, larger flow rates of cooling air, cooling water, or other fluids. Another option may be to add cooling tubes 202 surrounding the bed, so that hot combustion gases or fluids 204 can be flowed through the annular duct 200 during heating phases and then turned off while cooling water is flowed through the tubes 202 during cooling phases. Of course, suitable plumbing, valves, and controls for such heating and cooling fluids would have to be provided, but such plumbing, valves, and controls are within the capabilities of persons skilled in the art and need not be described here for an understanding of this invention.

Figure 10:
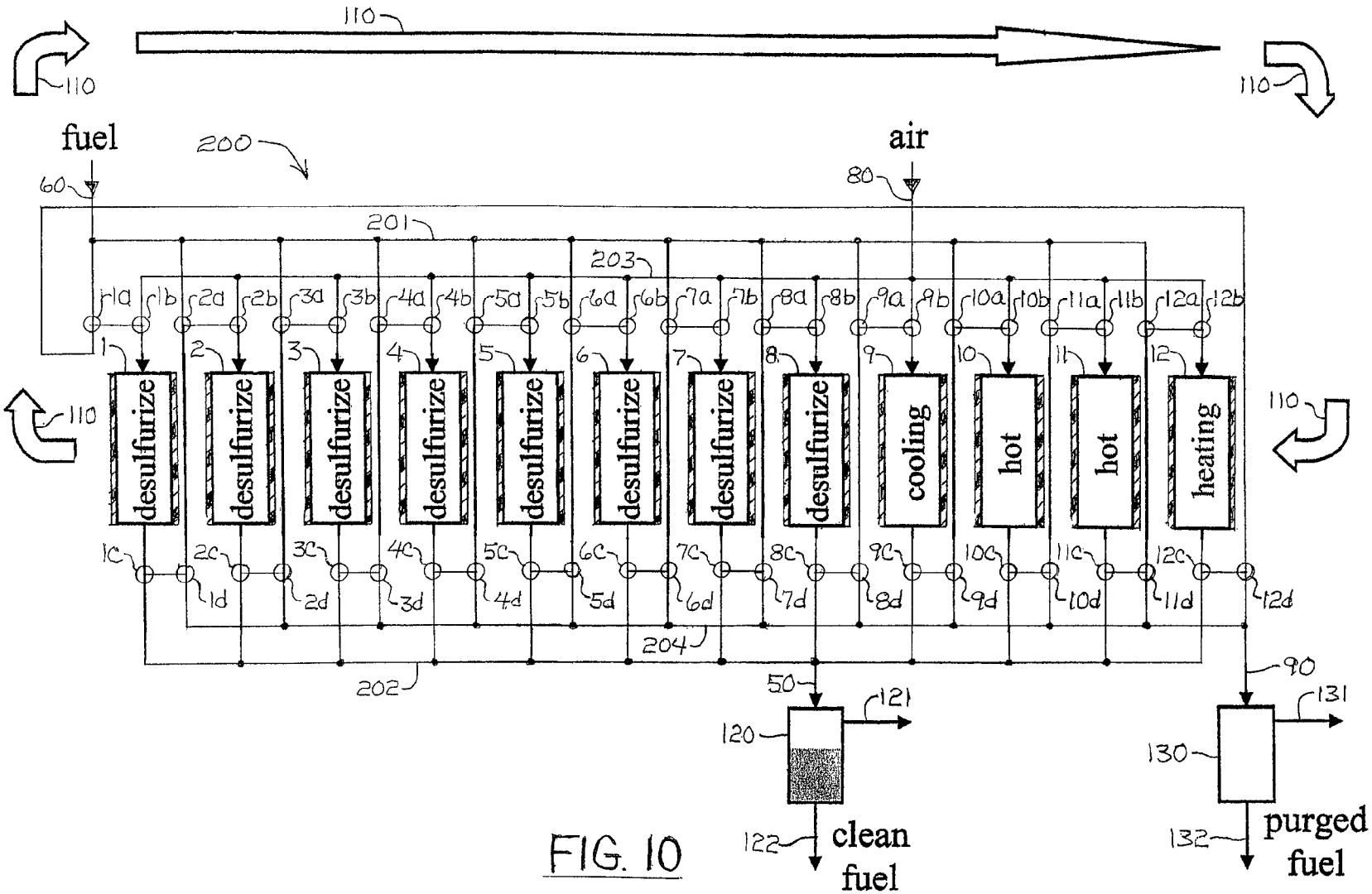
FIG. 10 is a schematic diagram of an alternate embodiment rapid cycle desulfurization system.

As mentioned above, the rotary valve 170 is not the only way to switch the fuel and air flows to simulate moving beds 1-12, i.e., to "move" or "rotate" the beds into and out of the desulfurization and regeneration phases described above. For example, the same rapid cycle process can be implemented by the apparatus 200 shown schematically in FIG. 10 in which the bottoms of beds 1-12 are connected to the tops of respective following beds, as described above. However, in this FIG. 10 apparatus 200, untreated fuel can flow from inlet 60 through a fuel inlet manifold 201 to any selected one or more of the beds 1-12 and desulfurized fuel can flow from any selected one or more of the beds 1-12 through a fuel outlet manifold 202 to fuel outlet 50. Likewise, the regeneration air can flow from the air inlet 80 through an air inlet manifold 203 to any selected one or more of the beds 1-12, and the gas by-products and purged fuel can flow from any selected one or more of the beds 1-12 through a gas outlet manifold 204 to the effluent outlet 90. These selected flows can be implemented by setting the three-way valves 1*a-d*, 2*a-d*, 3*a-d*, 4*a-d*, 5*a-d*, 6*a-d*, 7*a-d*, 8*a-d*, 9*a-d*, 10*a-d*, 11*a-d*, and 12*a-d*. For example, in the desulfurization and regeneration phases illustrated in FIG. 10, where beds 1-8 are in the desulfurization phase and beds 9-12 are in the regeneration phase, untreated fuel is directed from inlet fuel manifold 201 into the top of bed 1 by the three-way valve 1*a*, while the three-way valve 1*b* prevents air from air inlet manifold 203 from flowing into the top of bed 1. At the same time, the three-way valves 11*c* and 1*d* are set to direct fuel flow from the bottom of bed 1 to the top of bed 2, while they also prevent fuel flow from bed 1 into either the fuel outlet manifold 202 or the by-product outlet manifold 204. The three-way valves 2*a-d*, 3*a-d*, 4*a-d*, 5*a-d*, 6*a-d*, and 7*a-d* are set to keep the fuel flowing from bed 1 through beds 2, 3, 4, 5, 6, 7, and 8, while the three-way valve 8*c* is set to direct the desulfurized fuel from the bottom of bed 8 into the fuel outlet manifold 202 to the fuel outlet 50. The three-way valves 9*a* and 9*b* are set to direct regeneration air from air inlet 80 and air inlet manifold 203 into the top of bed 9, while three-way valves 9*c-d*, 10*a-d*, 11*a-d*, and 12*a-b* are set to direct the air flow from bed 9 through bed 10 and bed 11 into bed 12. The three-way valves 12*c* and 12*d* are set to direct the regeneration by-products and purged fuel from the bottom of bed 12 into the by-product outlet manifold 204 from where it flows to the by-product outlet 90.

Then, when sulfur breakthrough occurs or is about to occur in bed 8, bed 1 is rotated out of the desulfurization phase and into the regeneration phase behind bed 12 by switching three-way valve 12*d* to send the regeneration air and by-products flow from the bottom of bed 12 to the top of bed 1, switching three-way valve 1*a* to allow that air and by-product flow from the bottom of bed 12 into the top of bed 1, and switching the three-way valve 1*d* to direct the purge fuel and regeneration by-product flow from the bottom of bed 1 to the outlet manifold 204 and outlet 50. At the same time, the regenerated bed 9 is moved or rotated into the end of the desulfurization phase behind bed 8 by switching three-way valves 8*c*, 8*d*, and 9*a* to direct fuel flow from the bottom of bed 8 to the top of bed 9, by switching the three-way valves 9*b* to stop the air flow from air inlet 80 into bed 9 and to allow the fuel flow from bed 8 into the top of regenerated bed 9, and switching valve 9*c* to direct desulfurized fuel flow from the bottom of bed 9 into the fuel outlet manifold 202 and to the fuel outlet 50. The three-way valve 2*a* is switched to direct untreated fuel from the fuel inlet 60 and fuel inlet manifold 201 into the top of bed 2. Also at the same time, the three-way valve 10*b* is switched to allow regeneration air to flow from the air inlet 80 and air inlet manifold 203 into the top of bed 10.

Then, when sulfur breakthrough occurs or is about to occur in bed 8, bed 1 is rotated out of the desulfurization phase and into the regeneration phase behind bed 12 by switching three-way valve 12*d* to send the regeneration air and by-products flow from the bottom of bed 12 to the top of bed 1, switching three-way valve 1*a* to allow that air and by-product flow from the bottom of bed 12 into the top of bed 1, and switching the three-way valve 1*d* to direct the purge fuel and regeneration by-product flow from the bottom of bed 1 to the outlet manifold 204 and outlet 50. At the same time, the regenerated bed 9 is moved or rotated into the end of the desulfurization phase behind bed 8 by switching three-way valves 8*c*, 8*d*, and 9*a* to direct fuel flow from the bottom of bed 8 to the top of bed 9, by switching the three-way valves 9*b* to stop the air flow from air inlet 80 into bed 9 and to allow the fuel flow from bed 8 into the top of regenerated bed 9, and switching valve 9*c* to direct desulfurized fuel flow from the bottom of bed 9 into the fuel outlet manifold 202 and to the fuel outlet 50. The three-way valve 2*a* is switched to direct untreated fuel from the fuel inlet 60 and fuel inlet manifold 201 into the top of bed 2. Also at the same time, the three-way valve 10*b* is switched to allow regeneration air to flow from the air inlet 80 and air inlet manifold 203 into the top of bed 10.

Again, the apparatus 100, 200 are not the only apparatus that can be used to implement the rapid cycle desulfurization process of this invention. They are just examples of such apparatus. Many other kinds of valves, valve actuator and drive mechanisms, plumbing configurations, and bed arrangements could also be used for the method of this invention.

Also, the sorbents of this invention can also be used in actual moving bed desulfurization processes in which the sorbent is not divided into separate beds, but is propelled to actually move or flow in a direction counter to the flow of the fuel in the desulfurization phase and counter to the flow of air and/or reducing gas in the regeneration phase. Such actual counter flow of sorbent can be implemented by an auger in a tube, a conveyor in a channel, or the like. Of course, the sorbents of this invention can also be used in fixed bed or slow cycle desulfurization processes.

As mentioned above, effective desulfurization system capacity is maximized according to this invention by increasing the frequency of regeneration and not solely by increasing sorbent sulfur capacity. As also mentioned above, the best sorbents for this kind of system are among a family of ceramic supported metals and metal oxides. Particular combinations that exhibit both good capacity and excellent regeneration characteristics have been identified as part of this invention. Without being restricted to a particular theory, it is believed that the sorbents acquired their high capacity from the available support surface area and exhibit excellent regenerability characteristics through a catalytic effect of the supported metal. It has also been discovered as part of this invention that, while combination of high support surface with metals improves capacity slightly, more importantly, metal additives improve regeneration performance markedly.

Figure 11:
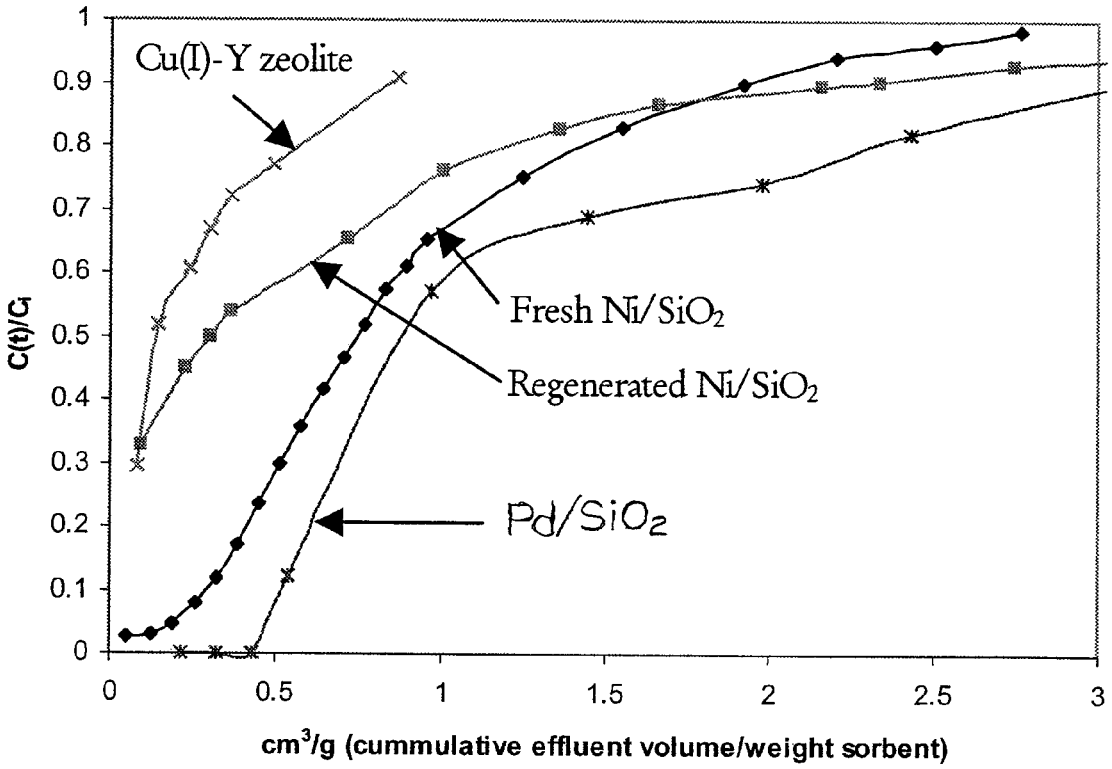
FIG. 11 is a graphical comparison of selected sorbents for the desulfurization of NATO F-76 fuel with 7,800 ppm sulfur.

Sorbent performance is characterized using single bed desulfurization of fuels and measuring the sulfur breakthrough curve in fuel collected from the outlet of the bed. Sulfur concentrations were measured using an Antek™ series 9000 total sulfur analyzer, which implements the preferred American National Standards Institute (ANSI) analysis method (D 5453) and is sensitive to about 0.5 ppm sulfur in real fuels. FIG. 11 shows breakthrough curves some of the sorbents that have been tested for the desulfurization of NATO F-76 fuel in the development of this invention. The breakthrough curve for copper(I) exchanged zeolite Y is substantially less than that expected from experiments with model fuels reported by A. J. Hermandez-Maldonado and R. T. Yang, "Desulfurization of Liquid Fuels by Adsorption via π-Complexation with Cu(I)—Y and Ag—Y Zeolites," *Ind. Eng. Chem. Res.*, vol. 42, pages 123-129 (2003). Substantial improvement was gained with reduced nickel supported on silica. This material was not regenerable in either oxidative or reducing conditions, however, and after four cycles the performance was not significantly better than the copper(I) Y zeolite. The loss in performance was probably due to formation of sulfided nickel, which is a very stable compound that is not conducive to oxidation or reduction regeneration reactions.

In contrast, the silica supported palladium ($Pd/SiO_2$) sorbent exhibited greatly improved performance both in capacity and regenerability. FIG. 11 shows the breakthrough curve for palladium on silica ($Pd/SiO_2$) after its fourth regeneration in air at 400° C. This breakthrough curve is not statistically different from its previous three breakthrough curves, which indicates there is no observable loss in capacity after four desulfurization-regeneration cycles.

Table 1 shows the sulfur saturation and breakthrough curves using palladium on silica (Pd/silica) and compares those values against those reported by A. J. Hernandez-Maldonado and R. T. Yang, supra. Note that experimental conditions between those reported experimental results and those used in the development of this invention were very different. The numbers presented in Table 1 for Pd/silica developed in this invention are for desulfurization of NATO F-76 marine diesel fuel with 7,800 ppm sulfur, which is a typical high sulfur concentration fuel used by the U.S. Navy, whereas the Hernandez-Maldonado and Yang (2003) numbers presented in Table 1 were collected for removal of 2,000 ppm thiophene from octane and benzene, which are the highest numbers for any condition reported. The numbers in Table 1 for the Pd/silica of this invention are biased because of the higher concentration of sulfur in the starting fuel (7,800 ppm), but the values of Hernandez-Maldonado and Yang (2003) in Table 1 are artificially high because of the simple fuel used to generate these capacities. Indeed, A. J. Hernandez-Maldonado and R. T. Yang, supra, also reported capacities for thiophene removal from benzene containing mixtures, which were substantially lower.

TABLE 1

Comparison of measured sulfur capacities for our new sorbent and the best prior reported values.

| | | Cu(I)-Y (Hernandez-Moldonado & Yang, 2003) | |
|---|---|---|---|
| | Pd/silica NATO F-76 (7,800 ppm S) | 2000 ppm thiophene in octane | 2000 ppm thiophene in benzene |
| Saturation Capacity ($mg/cm^3$) | 6.3 | 82 | 17 |
| Breakthrough Capacity ($mg/cm^3$) | 2.3 | 58 | 6.1 |

The demonstrated capacity and regenerability of Pd/silica are significant and demonstrate that regenerable sorbents for real fuels and with practical capacities are possible. The measured capacities capacities are indeed high enough for a practical and efficient desulfurization system, and no degradation in performance has been observed for either the silica supported palladium (Pd/silica) or the silica gel supported copper oxide (CuO/silica gel) developed as a part of this invention.

Both the Pd/silica and the CuO/silica gel sorbents can be made by conventional wet impregnation methods, wherein a metal salt is deposited onto a high surface area support material by soaking the support material in a metal salt solution and then drying the sorbent to leave behind a dry metal salt dispersed over the surface area. The supported salt is then oxidized to a metal or metal oxide by calcination.

EXAMPLE I

Copper oxide was deposited on a silica gel support by soaking the support in a metal nitrate solution, drying in air, and then calcining to convert the metal from the nitrate to the oxide form. 13.2 g of copper(II) nitrate hemipentahydrate (Aldrich™, product #223395) was dissolved in 80 g de-ionized $H_2O$ and 5.0015 g of $H_2SiO_2$ (Alfa Aesar™, silica gel product #42723) was soaked in solution for about three days. The nitrate solution was decanted off, and the sorbent was allowed to dry for about one day. The sorbent was then calcined with the following temperature program: Ramp from room temperature to 125° C. at 5° C./min (degrees centigrade per minute) dwell for two hours, then ramp to 650° C. at 10° C./min and dwell for two hours. The particle size for this sorbent is 100-200 μm (microns) and the support surface area is reported as 500-600 $m^2/g$ (square meters per gram), as purchased.

2.6 g (grams) of the copper oxide on silica gel sorbent was placed into a 0.25" O.D. (outside diameter), 0.20" I.D. (inside diameter) SS tube about 10" (inches) long, with 0.43 g of activated carbon (Aldrich™, product #292591) crushed and screened to 200-500 μm placed at the top of the bed. The bed was hooked to a desulfurization testing system. 8.5% $H_2$/He was run through the bed for three hours (3 hrs) at 400° C. to reduce the copper oxide to the base metal form.

Figure 12:
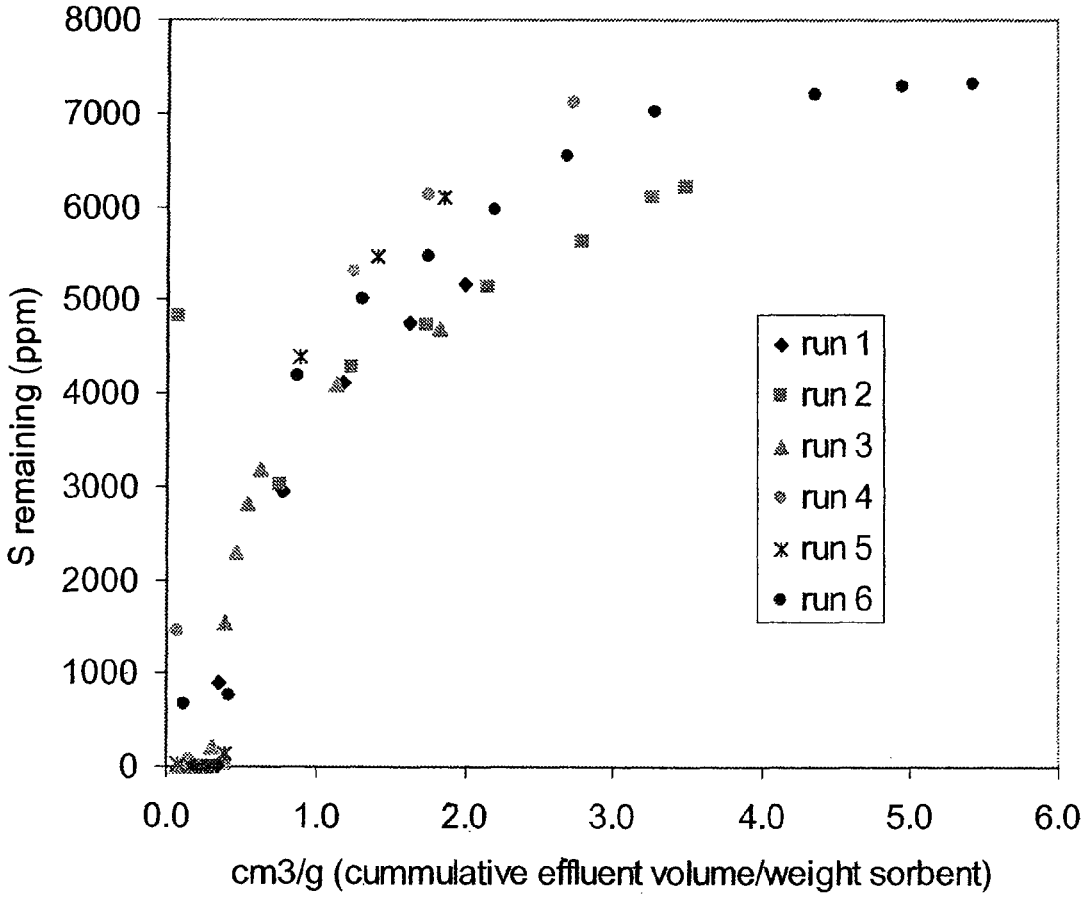
FIG. 12 is a graph showing sulfur breakthrough curves for silica gel supported copper sorbent for six sulfur adsorption-regeneration cycles.

Testing with NATO F-76 diesel fuel (containing 7,800 ppm sulfur) was performed on the single bed with six adsorption-regeneration cycles. The desulfurization step was carried out by flowing the fuel through the bed at a flow rate of 0.05 ml/min. The regeneration was done with two different stages: The first stage was an oxidation step and the second stage was a reduction step. Each stage was performed at 400° C. for at least three hours. Air was used as the oxidizing gas and an 8.5% $H_2$/He mixture was used for the reducing gas. FIG. 12 shows sulfur breakthrough curves during desulfurization after synthesis of the sorbent and after successive regenerations and shows that the sorbent is regenerable after several cycles. For some breakthrough curves, the first few effluent samples contain significant amounts of sulfur, but it is believed that these points are not due to sorbent properties but rather an artifact of the experiment. The ends of the bed do not reach the same temperature as the middle of the bed during regeneration, thus leaving some residual fuel after the regeneration step. This leftover fuel then gets picked up by the new fuel on the next adsorption cycle and comes out in the first sample. Indeed, higher temperature regeneration, which ensures the ends of the bed reach a temperature sufficient for regeneration, produces a significant decrease in initial breakthrough of sulfur.

EXAMPLE II

Another sorbent was formulated and tested in a similar manner to the copper sorbent described above. Palladium was deposited on a silica support, not silica gel. 6.309 grams of silica with a surface area of about 540 $m^2/g$ (square meters per gram) (Davison Catalyst, Davicat™ S11254) was soaked in a palladium nitrate solution prepared by mixing 0.9939 gram of palladium(II) nitrate hydrate (Aldrich™, produce #205761) in 10.0635 gram of DI $H_2O$. The nitrate solution was then decanted off and the sorbent air dried overnight. Calcination of the sorbent occurred at 500° C. for 1.5 hours with a 20° C./minute ramp from room temperature. The sorbent was then crushed and screened to 100-200 μm (micrometers) particle size; it was purchased 1-3 mm (millimeters) in size.

Figure 13:
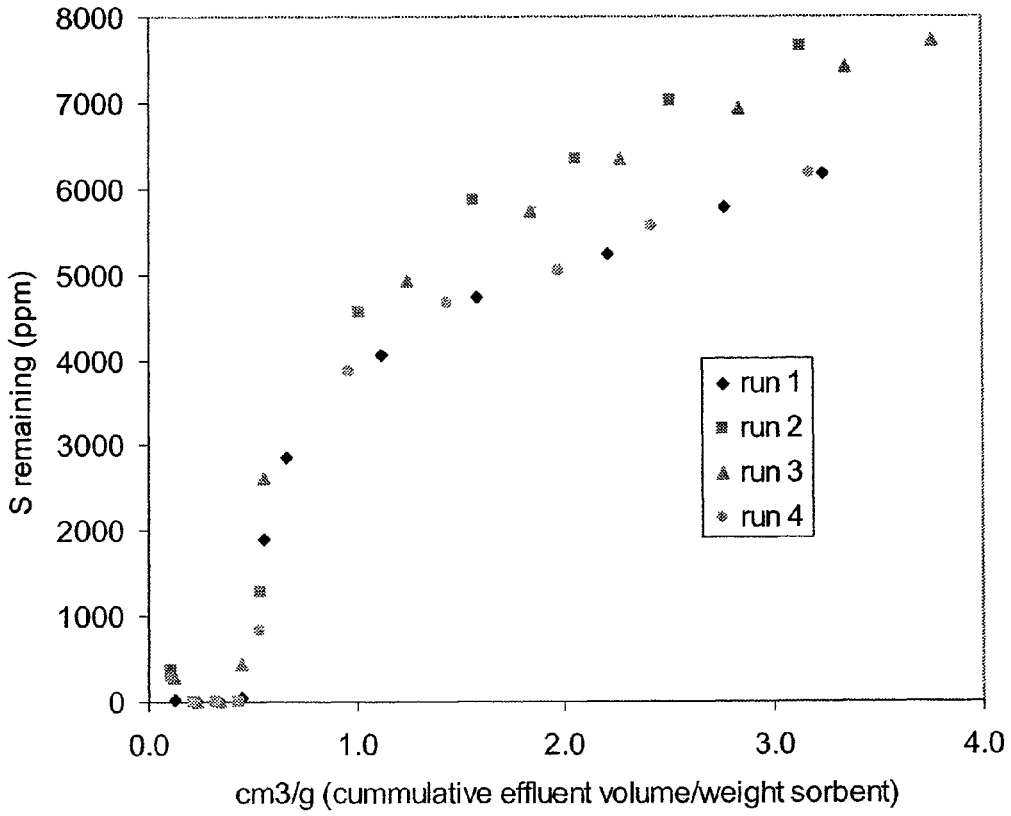
FIG. 13 is a graph showing sulfur breakthrough curves for silica supported palladium sorbent for four sulfur adsorption-regeneration cycles.

2.325 grams of palladium sorbent was placed in a reducing environment to convert the palladium oxide to base metal using 8.5% $H_2$/He at 500° C. for six hours. Four adsorption-regeneration cycles were performed on the sorbent with the first batch of NATO F-76 diesel fuel containing 7,800 ppm sulfur. The fuel flow rate through the bed was 0.05 ml/min (milliliters per minute). The sorbent was regenerated using two regeneration schemes: One with an oxidation and reduction process as described for the silica supported copper sorbent in Example I above, and the other with just an oxidation step. The first three cycles have the two part regeneration, while the fourth cycle was not reduced before adsorption; only oxidation was used to regenerate the sorbent. The capacity of the fourth cycle is similar to that of the first cycle, as shown in FIG. 13.

Figure 14:
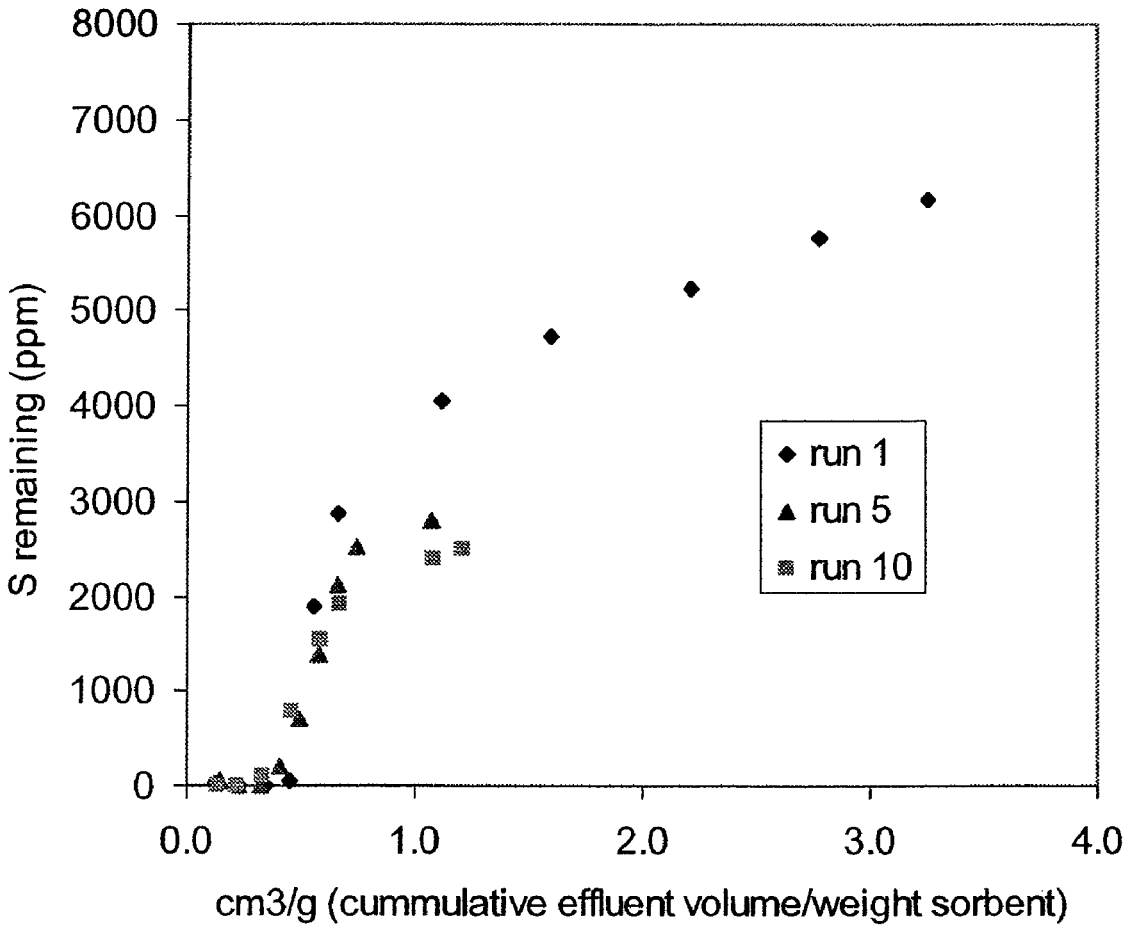
FIG. 14 is a graph comparing sulfur breakthrough curves of fifth and tenth sulfur adsorption-regeneration cycles of silica supported palladium sorbent to the first adsorption cycle of that sorbent, wherein the first breakthrough curve was for the treatment of NATO F-76 marine diesel fuel with about 7,800 ppm sulfur and the fifth and tenth cycles were for NATO F-76 with 3,500 ppm sulfur.

Two months later, the bed was reinserted into the testing system, this time using the new batch of NATO F-76 diesel fuel containing about 3,500 ppm sulfur and no reduction step in the regeneration scheme. To our knowledge, the first batch contained about 7,800 ppm (parts per million) sulfur. Thus far, a total of seventeen desulfurization-regeneration cycles have been performed on the bed. In a separate experiment using NATO F-76 diesel fuel containing about 3,500 ppm sulfur, twenty-one desulfurization and regeneration cycles have been demonstrated without any observable loss in capacity, and the experimentation is ongoing. FIG. 14 shows the data for the first adsorption cycle as well as the fifth and tenth adsorption cycles. The capacity of the sorbent is similar for those three adsorption cycles shown in FIG. 14, but there is a difference in the breakthrough curve due to the difference in fuels used for the testing. Current experimental efforts are focused on developing an optimized regeneration scheme by studying the amount of time, temperature, and air flow rate required for regeneration. Also, an initial air blow-out period is being used to get rid of excess fuel in the bed before healing to help reduce pressure drop and increase regeneration.

While the invention has been described above with explanations and examples of desulfurizing liquid fuels, the methods, apparatus, and materials of this invention can also be used to desulfurize gaseous fuels. For example, mercaptans or other sulfur containing molecular species are often added to natural gas in public distribution systems to impart a distinct odor to otherwise odorless natural gas, which enables persons to detect natural gas leaks or dangerous presence of natural gas in enclosed spaces. However, natural gas with such sulfurous odorants cannot be use din fuel cells. Therefore, this invention can also be used to remove such sulfurous odorants or other sulfur containing species from natural gas as well as from other gaseous hydrocarbon fuels and materials like propane, liquefied petroleum gas (LPG), and butane.

The foregoing description is considered as illustrative only of the principles of the invention. Furthermore, since numerous modifications and changes will readily occur to those skilled in the art, it is not desired to limit the invention to the exact construction and process shown and described above. Accordingly, resort may be made to all suitable modifications and equivalents that fall within the scope of the invention as defined by the claims which follow. The words "comprise," "comprises," "comprising," "include," "including", "includes", "contains", "containing", "have", and "having" when used in this specification are intended to specify the presence of stated features, integers, components, or steps, but do not preclude the presence or addition of one of more other features, integers, components, steps, or groups thereof.

The embodiments of the invention in which an exclusive property or privilege is claimed are defined as follows:

1. A method of desulfurizing hydrocarbon fuel comprising sulfur containing molecular species, comprising:

flowing the fuel comprising the molecular species sequentially through a series of desulfurizing beds of sorbent material that not only is capable of sorbing the molecular species, but that is also capable of being regenerated multiple times by desorbing and oxidizing the molecular species with air, wherein there is enough of the sorbent material in each bed in the series to decrease the sulfur concentration in the fuel flowing through each bed such that the sulfur concentration in the fuel flowing out of the last bed in the series does not exceed a desired maximum sulfur concentration level for a first period of time;

at the end of the first period of time, adding a regenerated bed of the adsorbent material to the end of the series of desulfurizing beds and removing the bed at the front of the series of desulfurizing beds;

adding the bed removed from the front of the series of desulfurizing beds to a series of regenerating beds;

heating at least some of the beds in the series of regenerating beds and flowing the air through the heated beds to desorb and oxidize the molecular species containing sulfur to regenerate the beds;

cooling at least one of the regenerated beds to prepare it for advancement into the end of the series of desulfurizing beds; and continuing flowing the fuel through the beds in the desulfurization series of beds to continue producing fuel from the last bed in the desulfurization series that does not exceed the desired maximum sulfur level for successive periods of time, removing beds from the front of the desulfurization series at the ends of such successive periods of time for the regeneration with hot air, and adding regenerated beds to the end of the desulfurization series as the beds are removed from the front of the desulfurization series.

2. A method of desulfurizing a hydrocarbon fuel containing sulfur-containing molecular species, comprising:

incrementally rotating a plurality of sorbent beds sequentially into and out of a desulfurization series while flowing the fuel through the desulfurization series counter to progression of the sorbent beds through the desulfurization series to sorb the sulfur-containing molecular species with sorbent material in the sorbent beds; and simultaneously progressing beds rotated out of the desulfurization series through a regeneration series where the sorbent beds are regenerated by heating the sorbent beds, desorbing and oxidizing the sulfur-containing molecular species from the sorbent material with hot air, and cooling the sorbent beds in preparation for rotation back into the desulfurization series.

3. The method of claim 2, including rotating the sorbent bed that is first to receive the flow of fuel out of the desulfurization series when the fuel flowing out of the last sorbent bed to receive the flow of fuel has a breakthrough of sulfur, and rotating a regenerated bed into the desulfurization series downstream from the adsorbent bed that has the breakthrough of sulfur to prevent sulfur concentration of the fuel flowing out of the desulfurization series from exceeding breakthrough sulfur concentration.

4. The method of claim 1, wherein the sorbent material comprises a high surface area support material coated with a metal.

5. The method of claim 4, wherein the metal is a combustion catalyst.

6. The method of claim 4, wherein the metal comprises palladium.

7. The method of claim 4, wherein the metal comprises copper.

8. The method of claim 4, wherein the metal comprises rhodium.

9. The method of claim 4, wherein the metal comprises platinum.

10. The method of claim 4, wherein the metal is in an oxide compound of the metal.

11. The method of claim 6, wherein at least some of the palladium is in an oxide compound of the palladium.

12. The method of claim 7, wherein at least some of the copper is in an oxide compound of the copper.

13. The method of claim 8, wherein at least some of the rhodium is in an oxide compound of the rhodium.

14. The method of claim 9, wherein at least some of the platinum is in an oxide compound of the platinum.

15. The method of claim 4, wherein the high surface area support material comprises silica.

16. The method of claim 4, wherein the high surface area support material comprises silica gel.

17. The method of claim 4, wherein the support material has a surface area of at least 100 $m^2/g$.

18. The method of claim 4 wherein the support material has surface area of at least 300 $m^2/g$.

19. The method of claim 1, wherein the sorbent material comprises a high surface area silica.

20. The method of claim 1, wherein the sorbent material comprises a high surface area silica gel.

21. The method of claim 4, wherein the high surface area support material comprises alumina.

22. The method of claim 4, wherein the high surface area support material comprises activated carbon.

23. The method of claim 4, wherein the high surface area support material comprises zeolite.

24. The method of claim 4, wherein the high surface area support material comprises a metal oxide.

25. A method for purifying a fluid comprising contaminant species, comprising:

incrementally rotating a plurality of sorbent beds containing sorbent material into and out of a purification series while flowing the fluid through the purification series counter to progression of the sorbent beds through the purification series to sorb the contaminant species with the material; and simultaneously progressing the beds that are rotated out of the purification series through a regeneration series where the sorbent material in those sorbent beds are regenerated by heating the sorbent beds, desorbing the contaminant species from the sorbent material with regeneration fluid, and cooling the sorbent beds in preparation for rotation of those beds back into the purification series.

26. The method of claim 25, wherein the containment species comprises sulfur.

27. The method of claim 26, wherein the purification series comprises a desulfurization series.

28. The method of claim 27, wherein the regeneration fluid comprises oxygen.

29. The method of claim 28, wherein the regeneration fluid comprises air.

30. The method of claim 28, wherein the regeneration fluid comprises hydrogen.

31. The method of claim 25, wherein the sorbent material comprises a metal supported by a high surface area support material.

32. The method of claim 31, wherein the metal comprises palladium.

33. The method of claim 32, wherein at least some of the palladium is in its reduced form.

34. The method of claim 32, wherein at least some of the palladium is in its oxidized form.

35. The method of claim 33, wherein the metal comprises copper.

36. The metal of claim 35, wherein at least some of the copper is in its reduced form.

37. The method of claim 35, wherein at least some of the copper is in its oxidized form.

38. The method of claim 31, wherein the metal comprises rhodium.

39. The method of claim 38, wherein at least some of the rhodium is in its reduced form.

40. The method of claim 38, wherein at least some of the rhodium is in its oxidized form.

41. The method of claim 31, wherein the metal comprises platinum.

42. The method of claim 41, wherein at least some of the platinum is in its reduced form.

43. The method of claim 41, wherein at least some of the platinum is in its oxidized form.

44. The method of claim 31, wherein the high surface area support material comprises silica.

45. The method of claim 44, wherein the sorbent material comprises silica supported palladium.

46. The method of claim 31, wherein the high surface area support material comprises silica gel.

47. The method of claim 46, wherein the sorbent material comprises silica gel supported copper.

48. The method of claim 31, wherein the high surface area support material comprises zeolite.

49. The method of claim 31, wherein the high surface area support material comprises activated carbon.

50. The method of claim 31, wherein the high surface area support material comprises metal oxide.

51. The method of claim 31, wherein the surface area of the high surface area material is at least 100 $m^2/g$.

52. The method of claim 31, wherein the surface area of the high surface area material is at least 300 $m^2/g$.

53. The method of claim 31, wherein the surface area of the high surface area material is at least 600 $m^2/g$.

54. A method of desulfurizing a hydrocarbon fuel that is contaminated with a sulfur-containing molecular species, comprising:

incrementally rotating a plurality of sorbent beds sequentially into and out of a desulfurization series while flowing the fuel through the desulfurization series counter to progression of the sorbent beds through the desulfurization series to remove the sulfur-containing molecular species from the fuel, wherein said sorbent beds include a sorbent that has a preferential interaction with the sulfur-containing species, which is effective for removing the sulfur-containing species from the fuel;

simultaneously progressing sorbent beds rotated out of the desulfurization series through a regeneration series, where the sorbent is regenerated by flowing a regeneration fluid through the sorbent beds in the regeneration series.

55. The method of claim 54, wherein the hydrocarbon fuel is liquid.

56. The method of claim 54, wherein the hydrocarbon fuel comprises diesel fuel.

57. The method of claim 54, wherein the hydrocarbon fuel is gaseous.

58. The method of claim 54, wherein the hydrocarbon fuel comprises natural gas.

59. The method of claim 54, wherein the regeneration fluid is gaseous.

60. The method of claim 59, wherein the regeneration fluid comprises oxygen.

61. The method of claim 59, wherein the regeneration fluid comprises a reducing material.

62. The method of claim 54, wherein the regeneration fluid is a liquid.

63. The method of claim 62, wherein the regeneration fluid comprises a solvent in which the sulfur-containing molecular species is soluble.

64. The method of claim 54, wherein the sorbent comprises a solid material.

65. The method of claim 54, wherein the sorbent material comprises a combustion catalyst metal.

66. The method of claim 54, wherein the sorbent comprises a porous material.

67. The method of claim 54, wherein the sorbent comprises a reactive material.

68. The method of claim 54, wherein the sorbent comprises a membrane.

69. The method of claim 54, wherein the sorbent comprises a liquid.

70. The method of claim 54, wherein the sorbent comprises a reactive material.

71. The method of claim 54, wherein the sorbent comprises a solvent.

72. The method of claim 54, wherein the sorbent comprises a gas.

73. The method of claim 54, wherein the regeneration fluid is a gas.

74. The method of claim 73, wherein the regeneration fluid comprises oxygen.

75. The method of claim 73, wherein the regeneration fluid comprises air.

76. The method of claim 75, wherein the regeneration fluid comprises air at a temperature of at least 300 C.

77. The method of claim 54, wherein the regeneration fluid comprises a reducing material.

78. The method of claim 54, wherein the regeneration fluid comprises a solvent in which the sulfur-containing molecular species is soluble.

79. The method of claim 54, wherein the regeneration fluid is a liquid.

80. The method of claim 79, wherein the regeneration fluid comprises a solvent in which the sulfur-containing molecular species is soluble.

* * * * *